US011809092B2

(12) United States Patent
Endo

(10) Patent No.: US 11,809,092 B2
(45) Date of Patent: Nov. 7, 2023

(54) IMAGE FORMING APPARATUS

(71) Applicant: CANON KABUSHIKI KAISHA, Tokyo (JP)

(72) Inventor: Hiroto Endo, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/729,618

(22) Filed: Apr. 26, 2022

(65) Prior Publication Data

US 2022/0350273 A1 Nov. 3, 2022

(30) Foreign Application Priority Data

Apr. 30, 2021 (JP) ..... 2021-078187

(51) Int. Cl.

| | |
|---|---|
| ***G03G 15/02*** | (2006.01) |
| ***G03G 15/043*** | (2006.01) |
| ***G03G 15/08*** | (2006.01) |
| ***G03G 15/00*** | (2006.01) |
| ***G03G 21/18*** | (2006.01) |

(52) U.S. Cl.

CPC ..... *G03G 15/0266* (2013.01); *G03G 15/043* (2013.01); *G03G 15/0813* (2013.01); *G03G 15/5008* (2013.01); *G03G 15/5037* (2013.01); *G03G 21/1825* (2013.01)

(58) Field of Classification Search

CPC ..... G03G 15/0813; G03G 15/50; G03G 15/5008; G03G 15/043; G03G 21/1825

See application file for complete search history.

(56) References Cited

U.S. PATENT DOCUMENTS

| | | | | |
|---|---|---|---|---|
| 9,229,351 | B2 | 1/2016 | Funatani et al. | |
| 10,042,300 | B2 | 8/2018 | Endoh | |
| 2010/0316400 | A1* | 12/2010 | Murasaki | G03G 15/0131 399/53 |
| 2010/0316413 | A1* | 12/2010 | Murasaki | G03G 15/0194 399/228 |
| 2013/0108290 | A1* | 5/2013 | Funatani | G03G 15/0813 399/46 |

(Continued)

FOREIGN PATENT DOCUMENTS

| | | |
|---|---|---|
| JP | 2013-109322 A | 6/2013 |
| JP | 2018-045084 A | 3/2018 |

(Continued)

*Primary Examiner* — Carla J Therrien
(74) *Attorney, Agent, or Firm* — Venable LLP

(57) ABSTRACT

An image forming apparatus includes a photosensitive member, a charging member, an exposure unit, a developing unit including a developing member, a motor, a contact and separation unit, a controller, an acquiring portion for acquiring information on a switching time which is a time required for switching a state of the developing member from a separated state to a contact state by executing a contact operation by the contact and separation unit, and a setting portion for setting, on the basis of the information on the switching time acquired by the acquiring portion, a start timing which is a timing when the contact operation by the contact and separation unit is started in a preparation operation and which is a timing before a region on the photosensitive member exposed to light in a light emission period reaches a developing position.

13 Claims, 18 Drawing Sheets

(56) References Cited

U.S. PATENT DOCUMENTS

| | | | | |
|---|---|---|---|---|
| 2013/0169731 | A1* | 7/2013 | Mizuta | G02B 26/122 347/224 |
| 2014/0369704 | A1* | 12/2014 | Matsumoto | G03G 15/043 399/53 |
| 2019/0064692 | A1* | 2/2019 | Wakamiya | G03G 15/011 |
| 2019/0163087 | A1* | 5/2019 | Ishida | G03G 15/043 |
| 2019/0369539 | A1* | 12/2019 | Park | G03G 15/55 |

FOREIGN PATENT DOCUMENTS

| | | | |
|---|---|---|---|
| JP | 2019-040136 | A | 3/2019 |
| JP | 2019-174577 | A | 10/2019 |

* cited by examiner (a)

(b)

IMAGE FORMING APPARATUS

FIELD OF THE INVENTION AND RELATED ART

The present invention relates to an image forming apparatus, such as a printer, a copying machine, or a facsimile machine, of an electrophotographic type.

In the image forming apparatus such as a laser beam printer of the electrophotographic type, lifetime extension of various (component) parts is realized for improving an image quality and for reducing a running cost. For example, in a constitution employing a contact development type image forming apparatus in which an electrostatic latent image on a photosensitive member is developed by bringing a developing member such as a developing roller into contact with the photosensitive member, the developing member is separated (spaced) from the photosensitive member in advance during stand-by or the like and is contacted to the photosensitive member during image formation. By employing such a constitution, deterioration of the photosensitive member and the developing member is suppressed, so that the lifetime extension can be realized.

Further, in the image forming apparatus of the electrophotographic type, in order to realize stabilization of an image, various adjusting operations are performed at the time of rising (actuation) of an exposure device. For example, there is a constitution in which a part of scanning light from the exposure device is detected by a sensor ("BD sensor") and synchronization of an image writing position is made by the exposure device. In this constitution, at the time of actuation of the exposure device, in order to stably acquire a signal acquired by detection of laser light by the BD sensor, a laser is turned on for a predetermined time in an entire region including an image forming region with respect to a main scan direction ("forced light emission") in some instance.

In the case where a print operation is started, when the forced light emission is performed, the electrostatic latent image is formed. For that reason, in the case where the developing member is contacted to the photosensitive member when a region on the photosensitive member exposed to light by the forced light emission passes through a developing position where the photosensitive member and the developing member are in contact with each other, toner is moved from the developing member to the above-described region on the photosensitive member, so that the toner is unnecessarily consumed. Further, there is a possibility that this toner causes contamination of an image and a recording material with the toner during subsequent image formation.

In Japanese Laid-Open Patent Application (JP-A) 2013-109322, a constitution in which the toner is not consumed by adjusting a charging potential of the photosensitive member and a potential of the developing member even in the case where the developing member is contacted to the photosensitive member when the region on the photosensitive member exposed to light passes through the developing position during adjustment of the exposure device has been proposed.

By the constitution (method) of JP-A 2013-109322, it would be considered that movement of the toner to the region on the photosensitive member exposed to light during the actuation of the exposure device can be suppressed. However, in this method, there is a need to always apply and control a charging voltage and a developing voltage during the actuation of the exposure device, so that there is a possibility that control is liable to become relatively complicated and that this method is disadvantageous in terms of life times of the photosensitive member and the developing unit.

Here, when an operation in which the developing member is contacted to the photosensitive member is started after the image forming apparatus awaits passing of the exposed region on the photosensitive member through the developing position during the actuation of the exposure device, the movement of the toner to the region on the photosensitive member can be suppressed. However, the image forming apparatus is also required that a first print out time ("FPOT") which is a time from input of a print instruction until a recording material on a first page on which an image is formed is outputted is shortened. When the operation in which the developing member is contacted to the photosensitive member is started after the image forming apparatus awaits the passing of the region on the photosensitive member through the developing position, the FPOT becomes long.

SUMMARY OF THE INVENTION

A principal object of the present invention is to provide an image forming apparatus capable of shortening FPOT while suppressing movement of toner to a region on a photosensitive member exposed to light during actuation of an exposure device.

According to an aspect of the present invention, there is provided an image forming apparatus comprising: a photosensitive member rotatable in a predetermined rotational direction; a charging member configured to electrically charge a surface of the photosensitive member at a charging position with respect to the rotational direction; an exposure unit configured to expose, to light, the surface of the photosensitive member charged by charging member at an exposure position downstream of the charging position with respect to the rotational direction; a developing unit including a developing member rotatable and contactable to the surface of the photosensitive member at a developing position downstream of the exposure position and upstream of the charging position with respect to the rotational direction and configured to supply a developer to the photosensitive member by the developing member; a motor configured to drive the developing member; a contact and separation unit to which a driving force from the motor is transmitted and configured to switch a state of the developing member between a contact state in which the developing member is contacted to the photosensitive member and a separated state in which the developing member is separated from the photosensitive member; a controller configured to control the contact and separation unit so as to execute, before image formation, a light emitting operation for forming a potential at which the developer is capable of being deposited on the photosensitive member by exposing, to light, a region including an image forming region with respect to a rotational axis direction of the photosensitive member in a light emission period by the exposure unit, and a preparatory operation including actuation of the motor and a contact operation for switching the state of the developing member from the separated state to the contact state in a switching period by the contact and separation unit; an acquiring portion configured to acquire information on a switching time which is a time required for switching the state of the developing member from the separated state to the contact state by executing the contact operation by the contact and separation unit; and a setting portion configured to set, on the basis of the information on the switching time acquired by the acquiring portion, a start timing which is a timing when the contact operation by the contact and separation unit is started in the preparation operation and which is a timing before a region on the photosensitive member exposed to light in the light emission period reaches the developing position.

Further features of the present invention will become apparent from the following description of exemplary embodiments with reference to the attached drawings.

Figure 3:
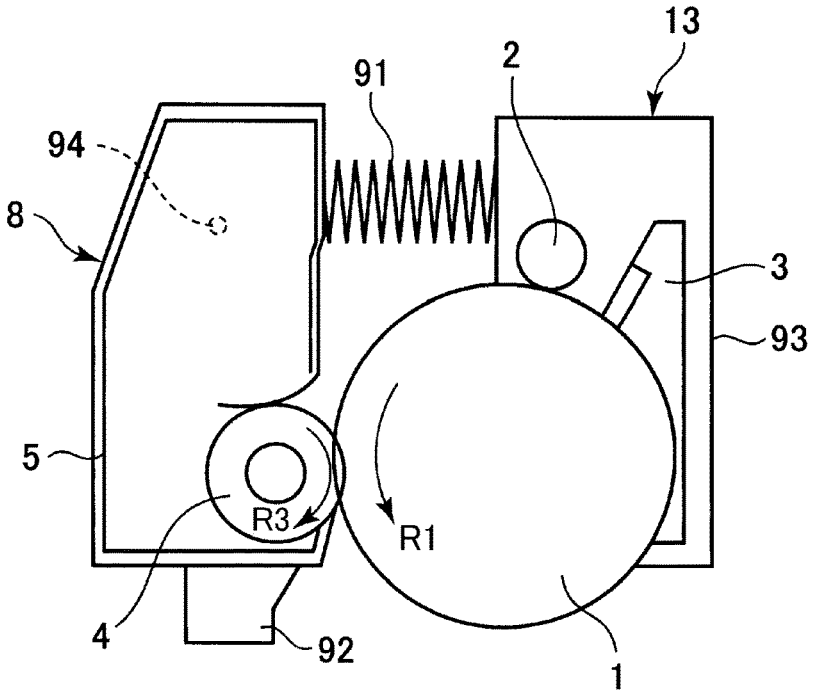
Figure 3:
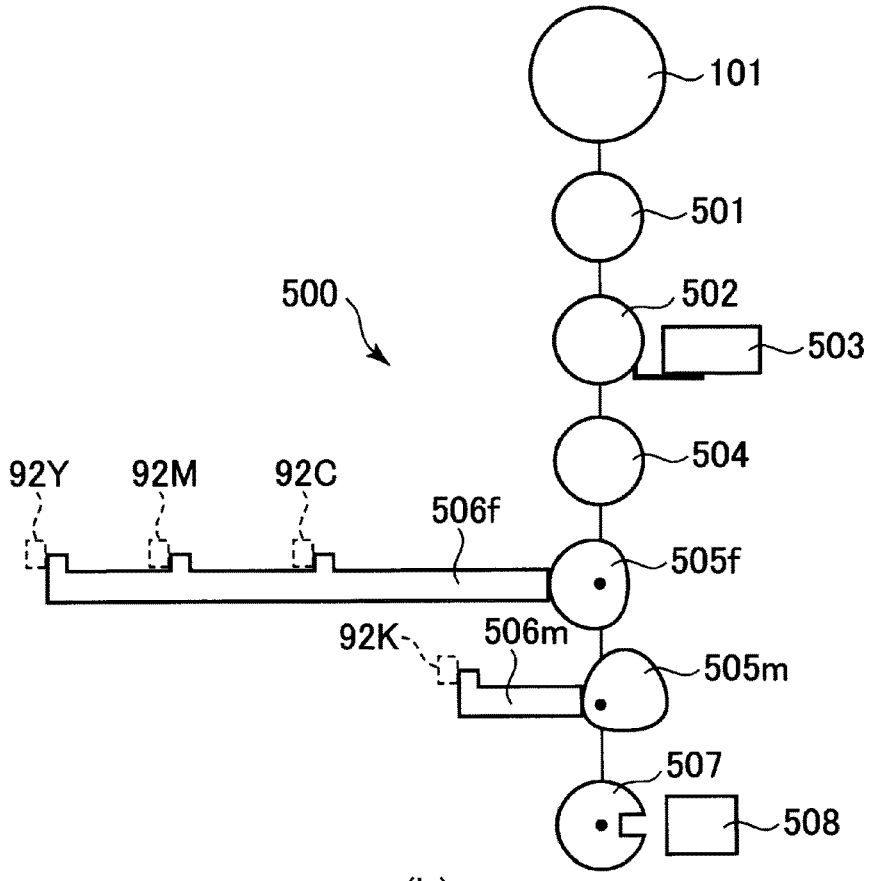

Parts (a) and (b) of FIG. 3 are a schematic sectional view of a process cartridge and a schematic view of a contact and separation unit, respectively.

Figure 4:
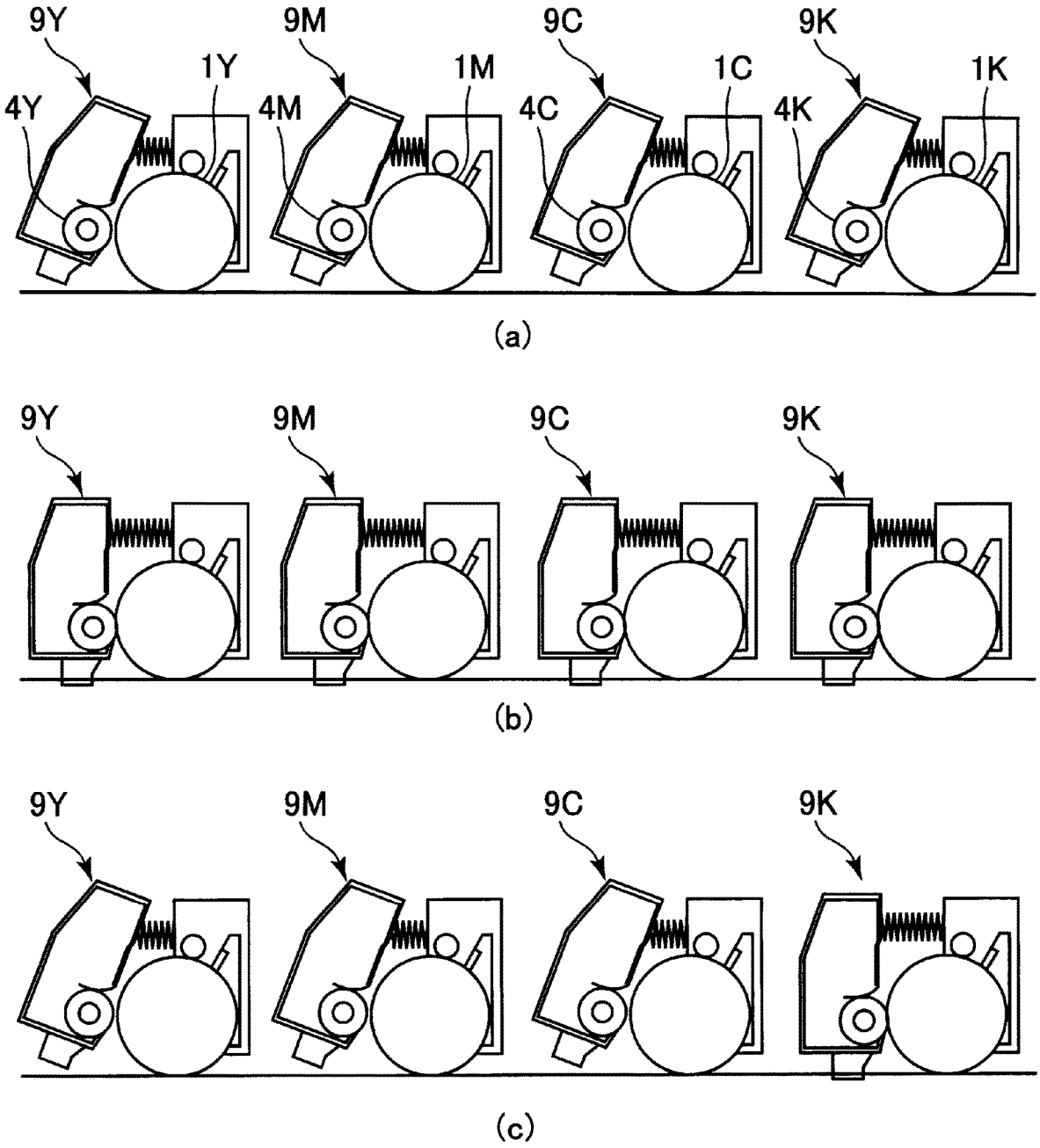

Parts (a) to (c) of FIG. 4 are schematic views for illustrating a contact and separation state of a developing roller.

Figure 5:
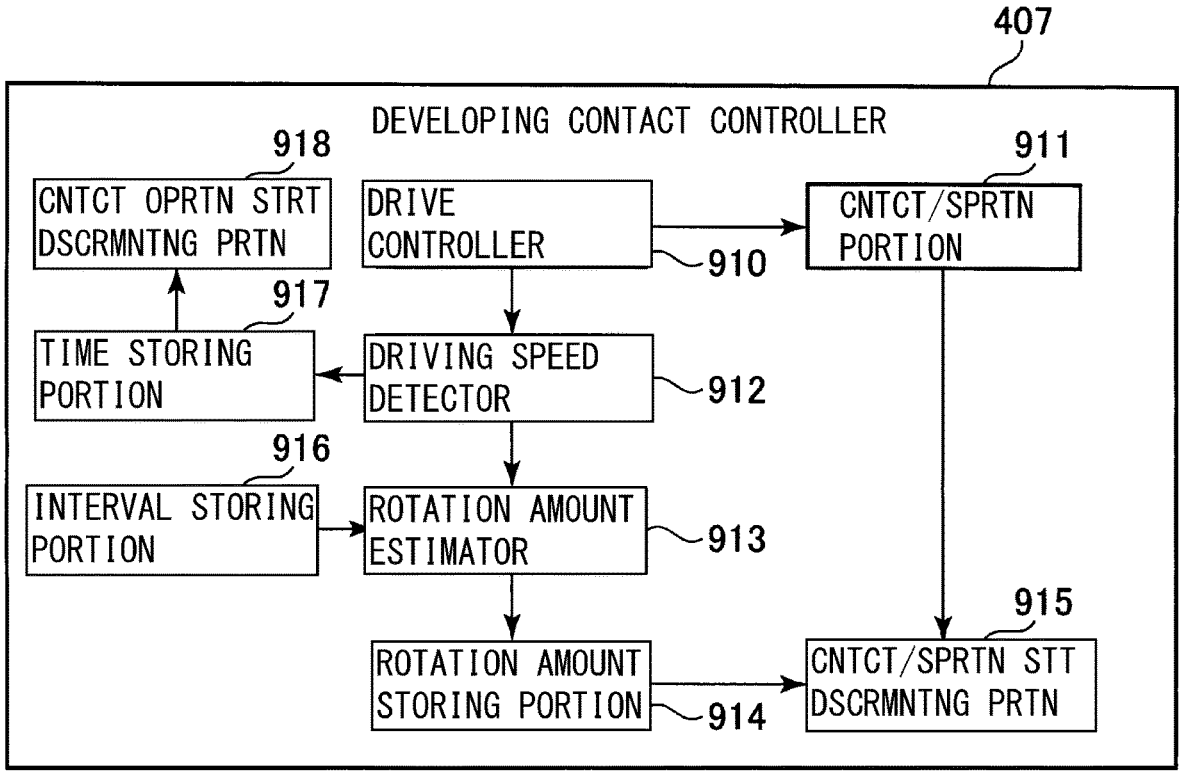

FIG. 5 is a function block diagram of a developing (roller) contact controller.

Figure 6:
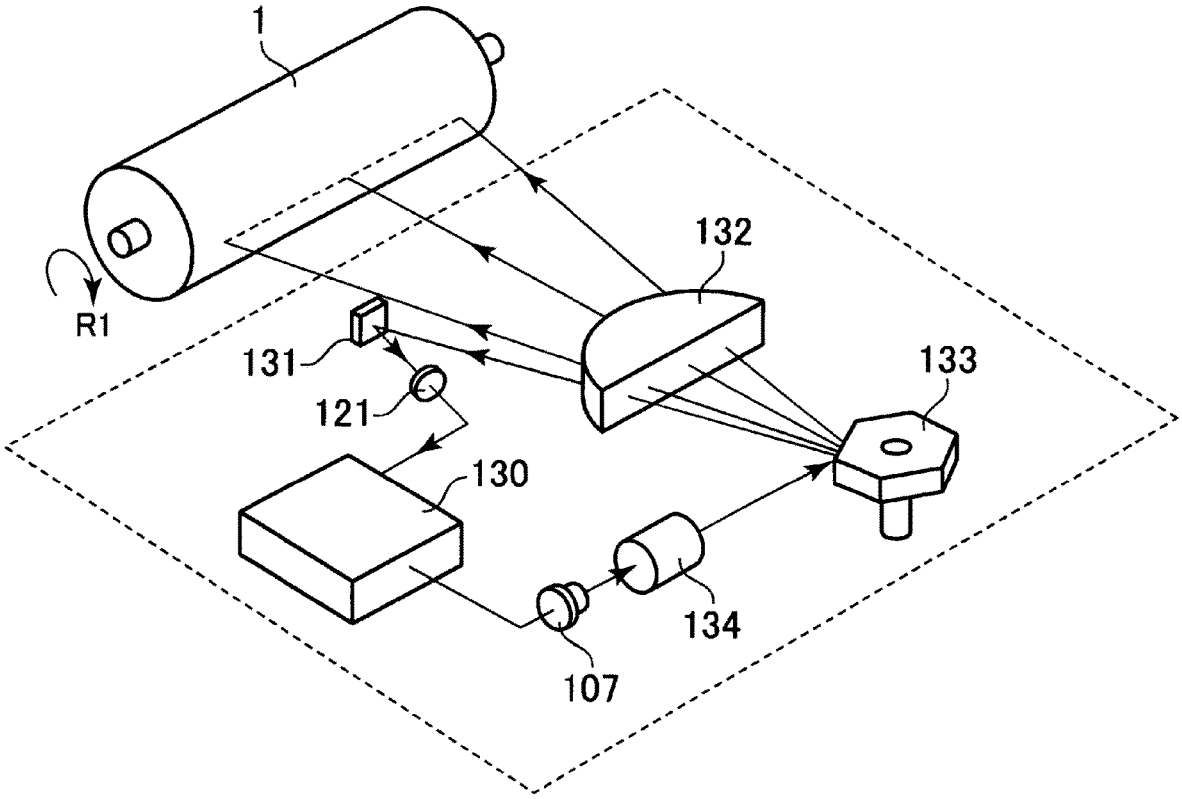

FIG. 6 is a schematic view of an exposure unit.

Figure 7:
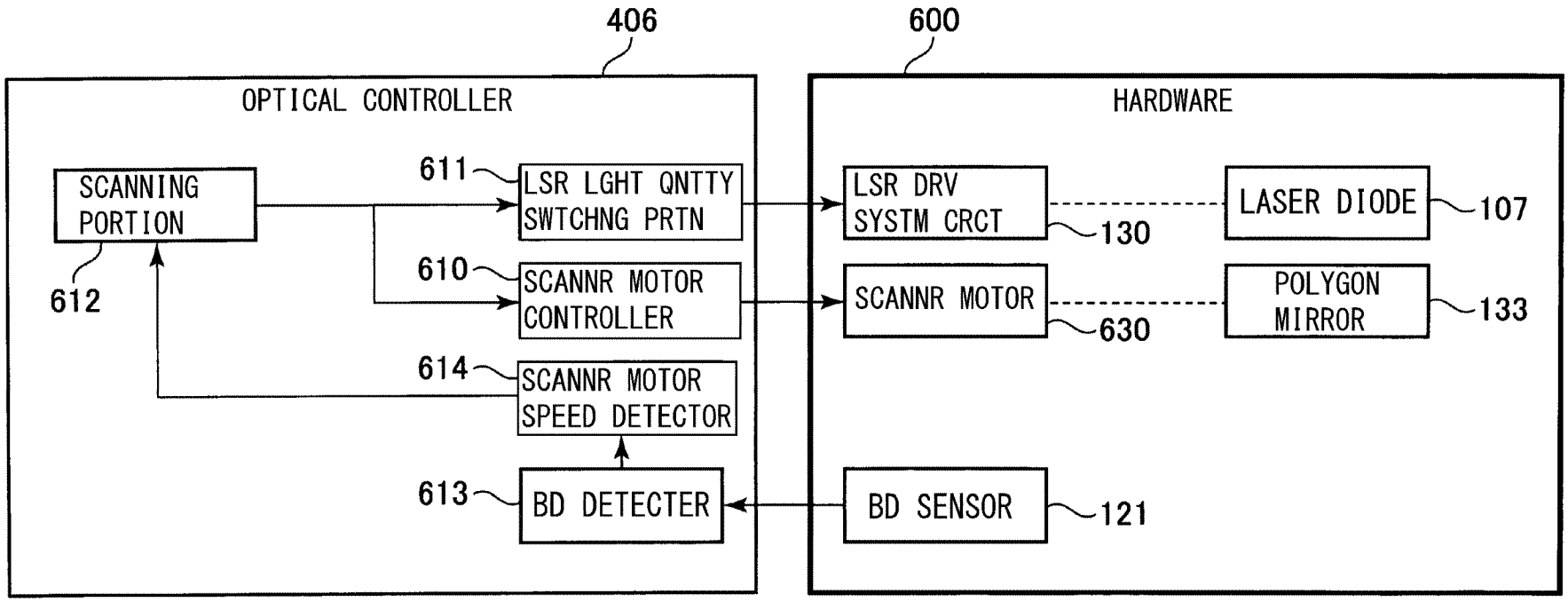

FIG. 7 is a block diagram showing a function block of an optical controller and hardware.

Figure 8:
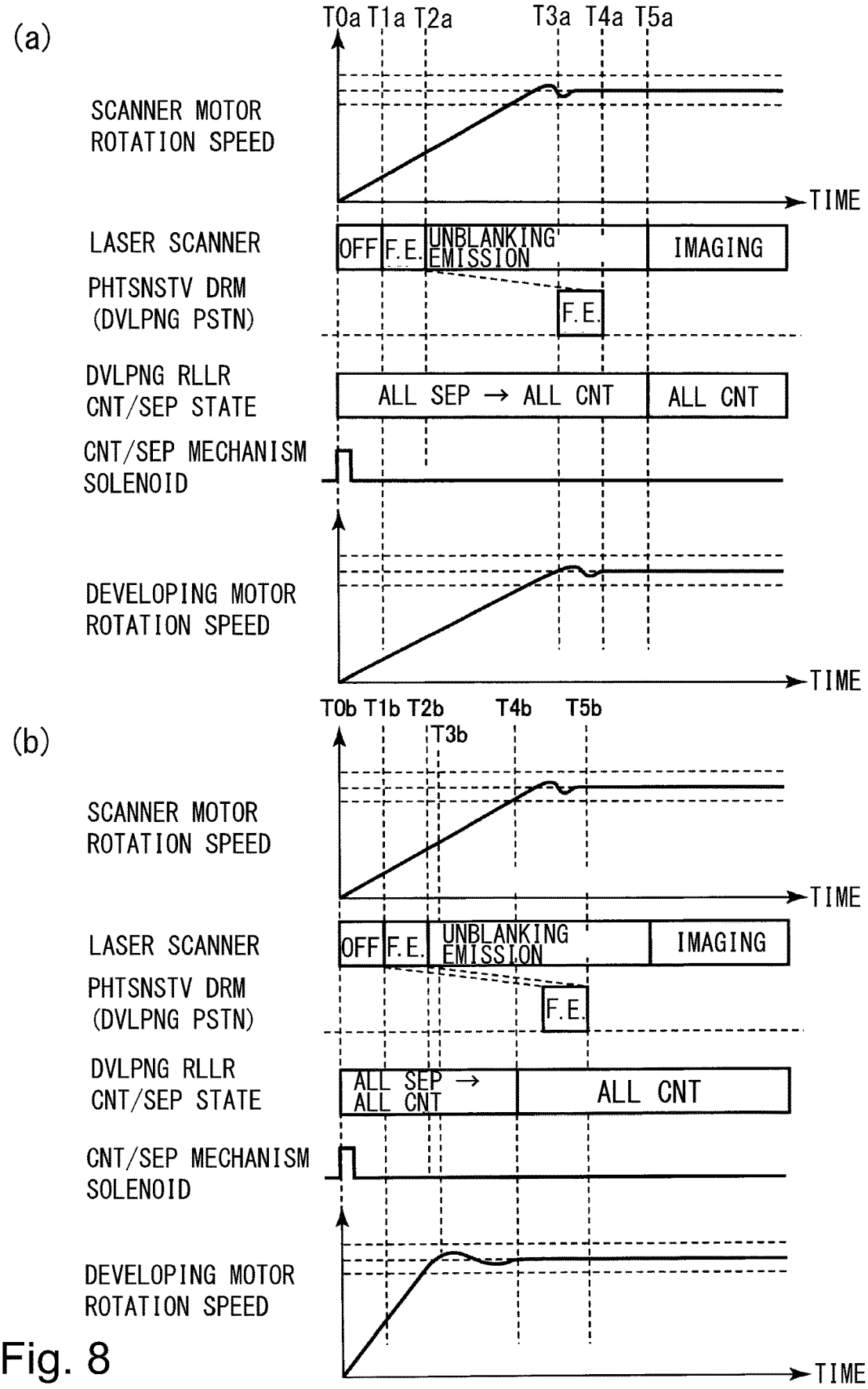

Parts (a) and (b) of FIG. 8 are timing charts for illustrating an example of a problem.

Figure 9:
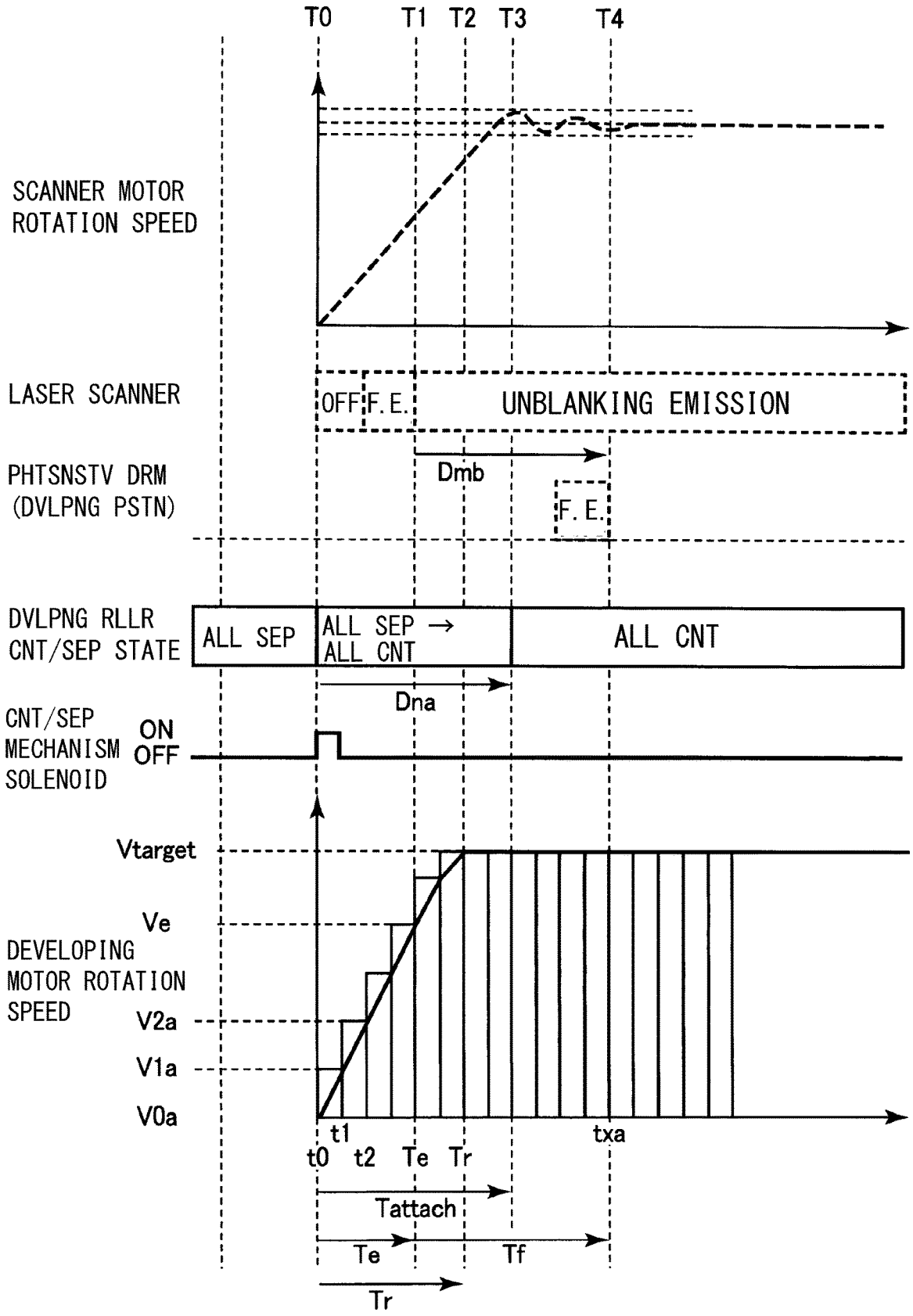

FIG. 9 is a timing chart for illustrating a measuring process during initialization operation.

Figure 10:
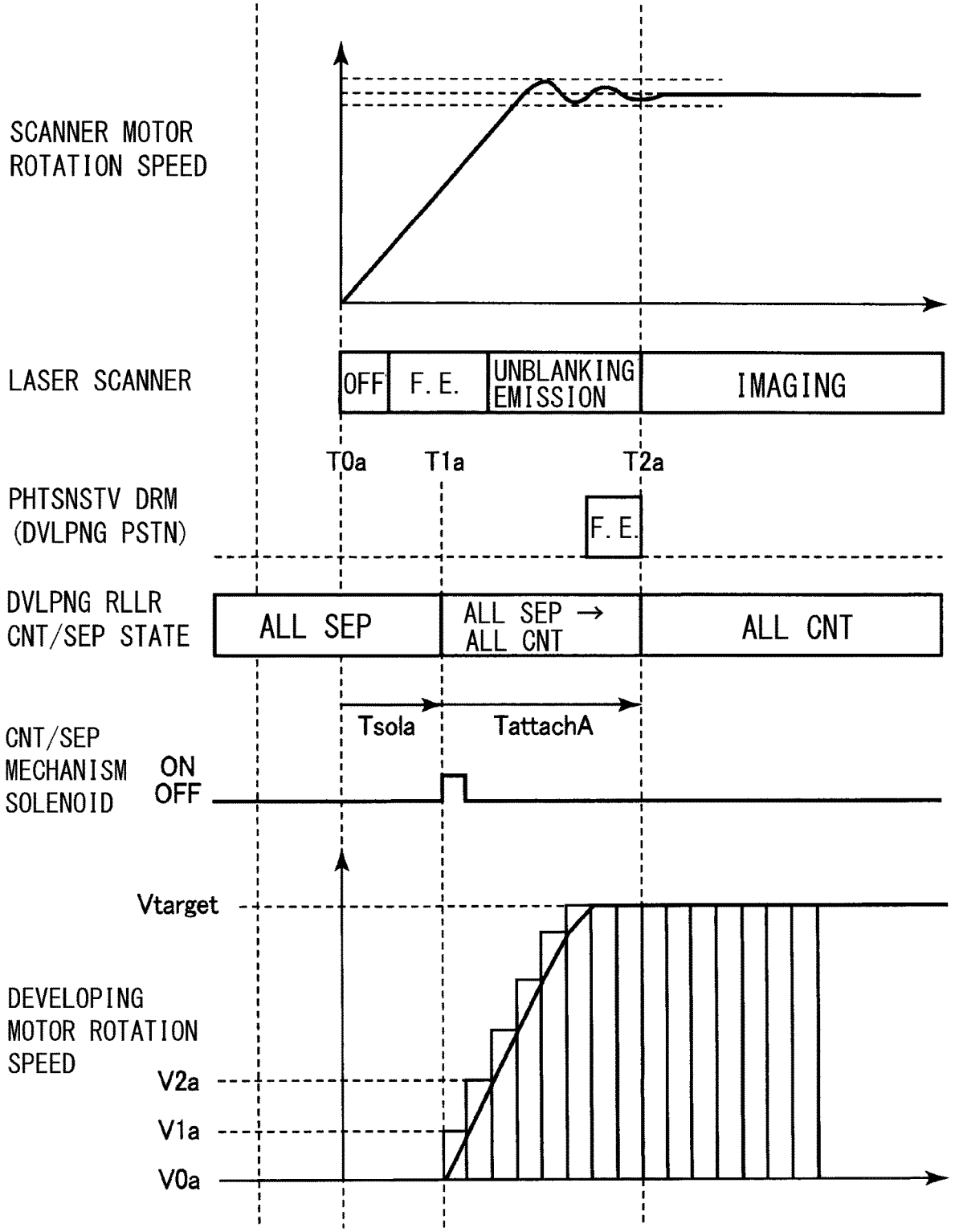

FIG. 10 is a timing chart of an example of a contact operation during a start of a print operation.

Figure 11:
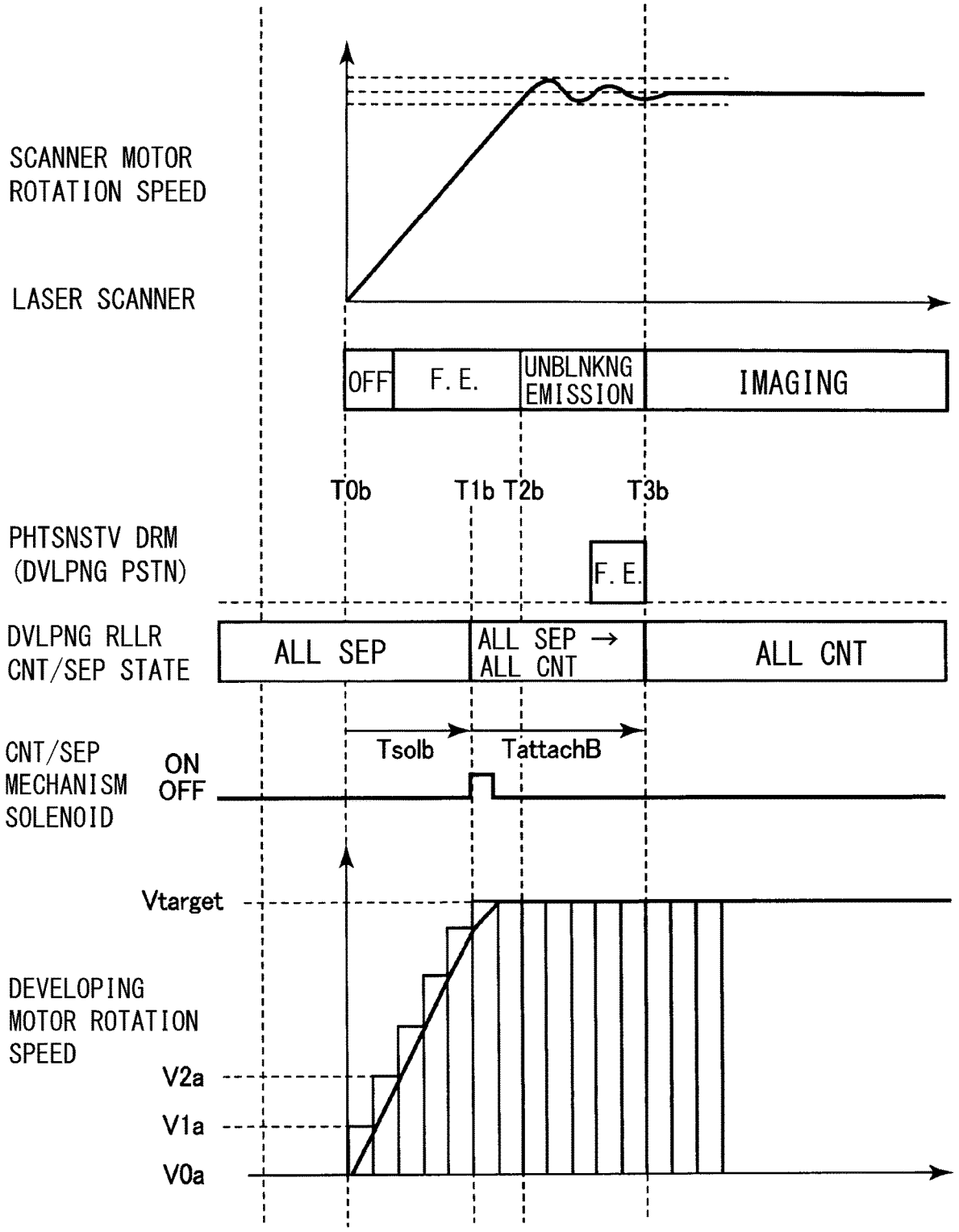

FIG. 11 is a timing chart of another example of the contact operation during the start of the print operation.

Figure 12:
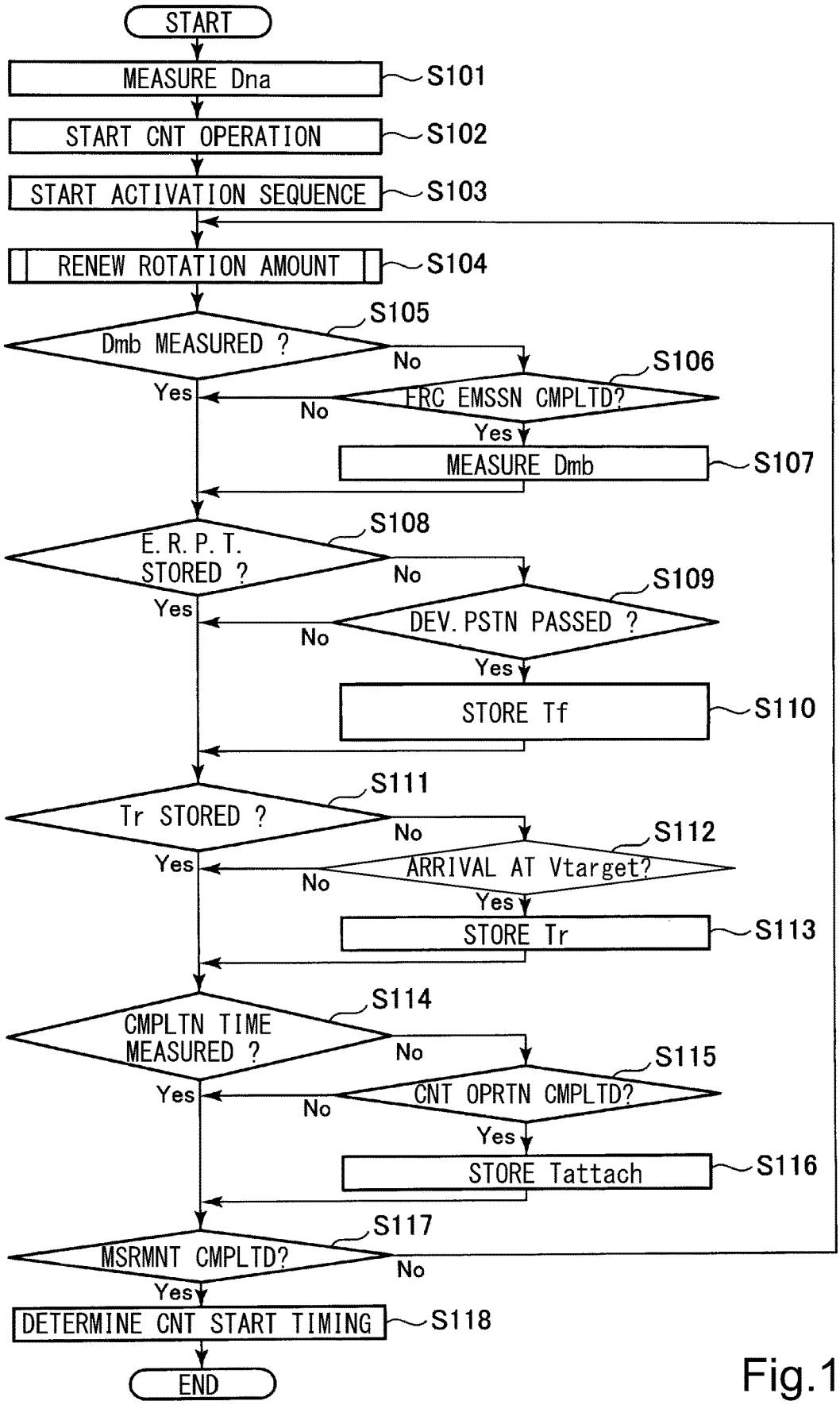

FIG. 12 is a flowchart of an example of the measuring process during the initialization operation.

Figure 13:
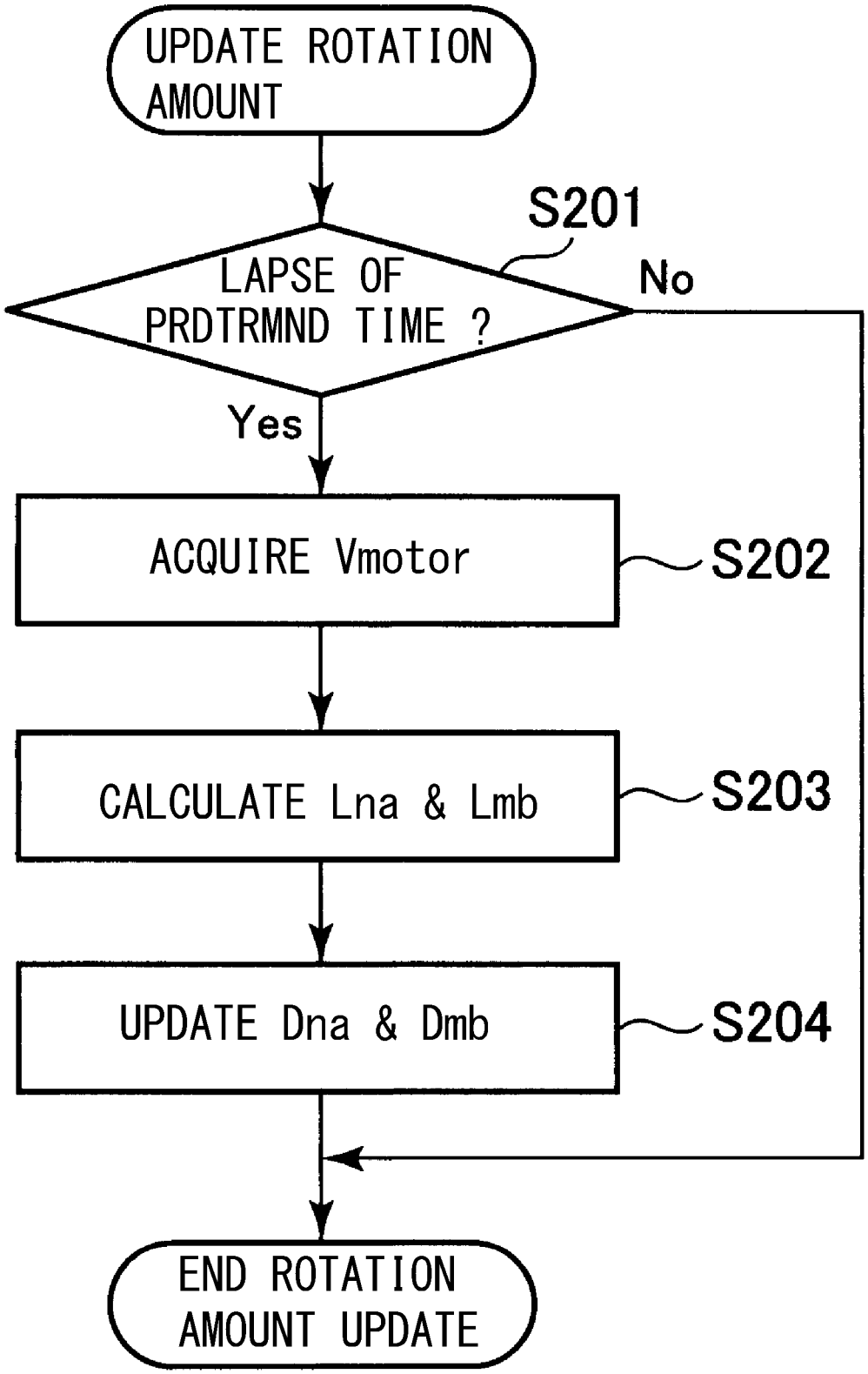

FIG. 13 is a flowchart of an example of a part of the measuring process in FIG. 12.

Figure 14:
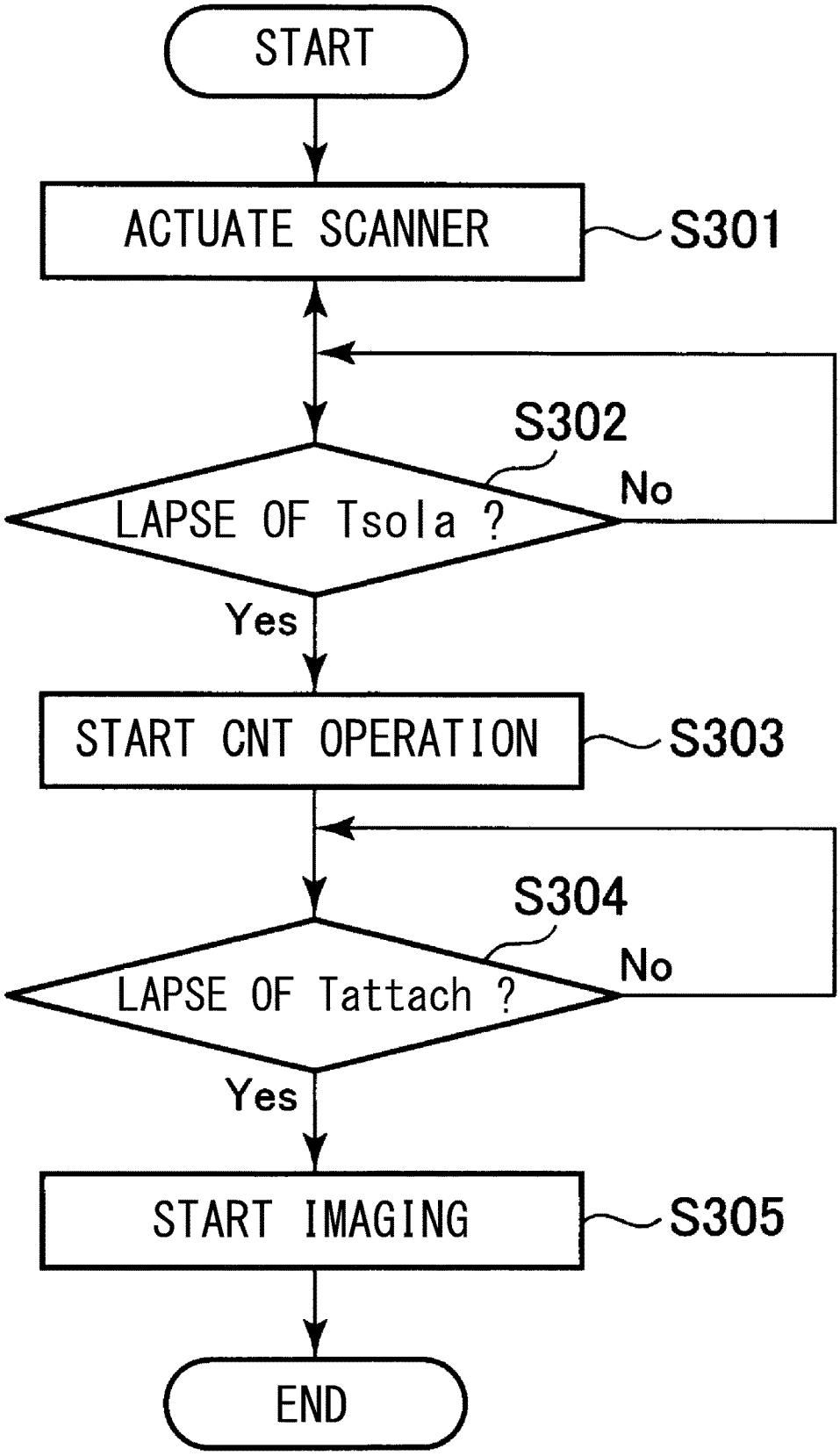

FIG. 14 is a flowchart of an example of the contact operation during the start of the print operation.

Figure 15:
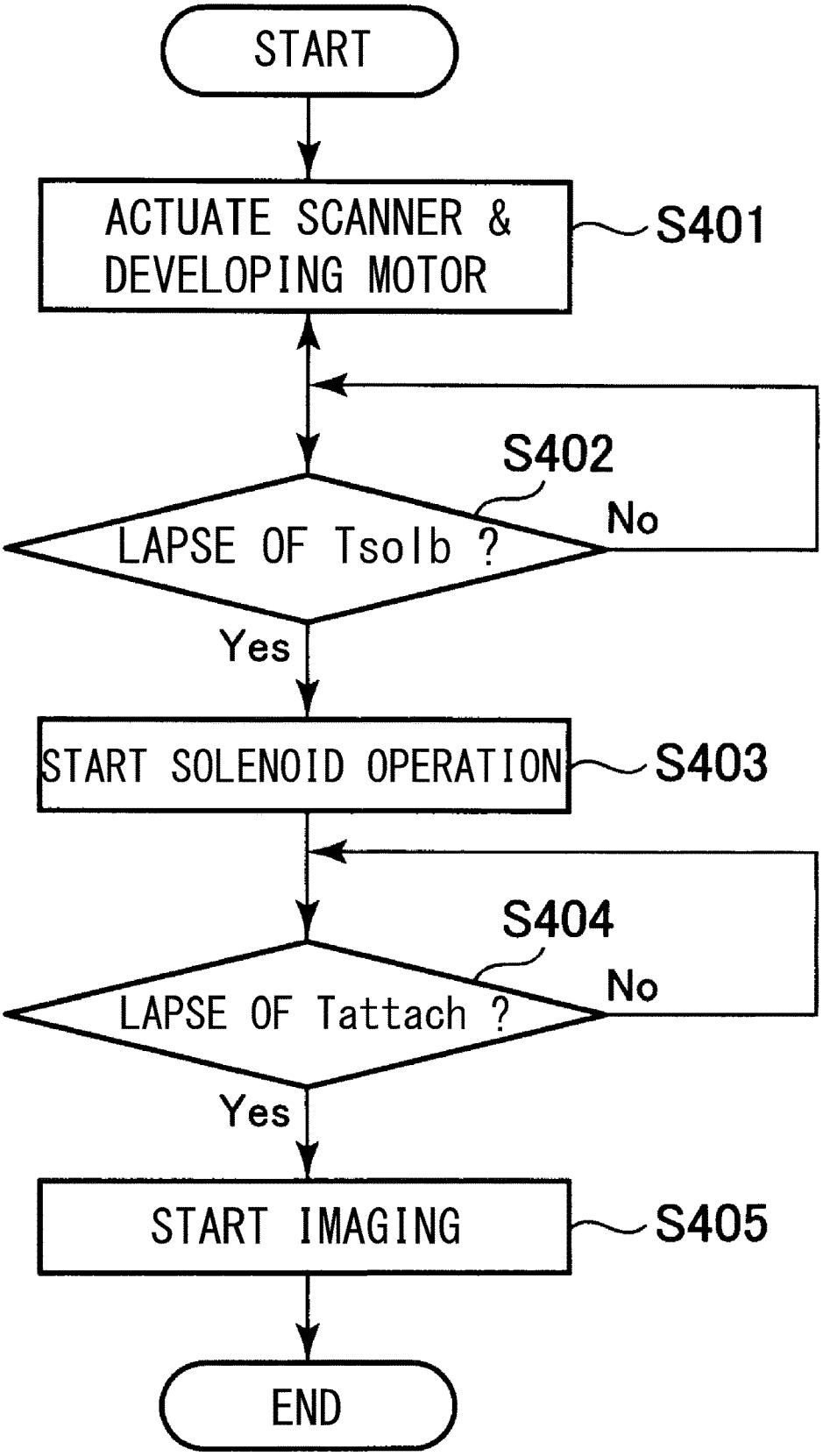

FIG. 15 is a flowchart of another example of the contact operation during the start of the print operation.

Figure 16:
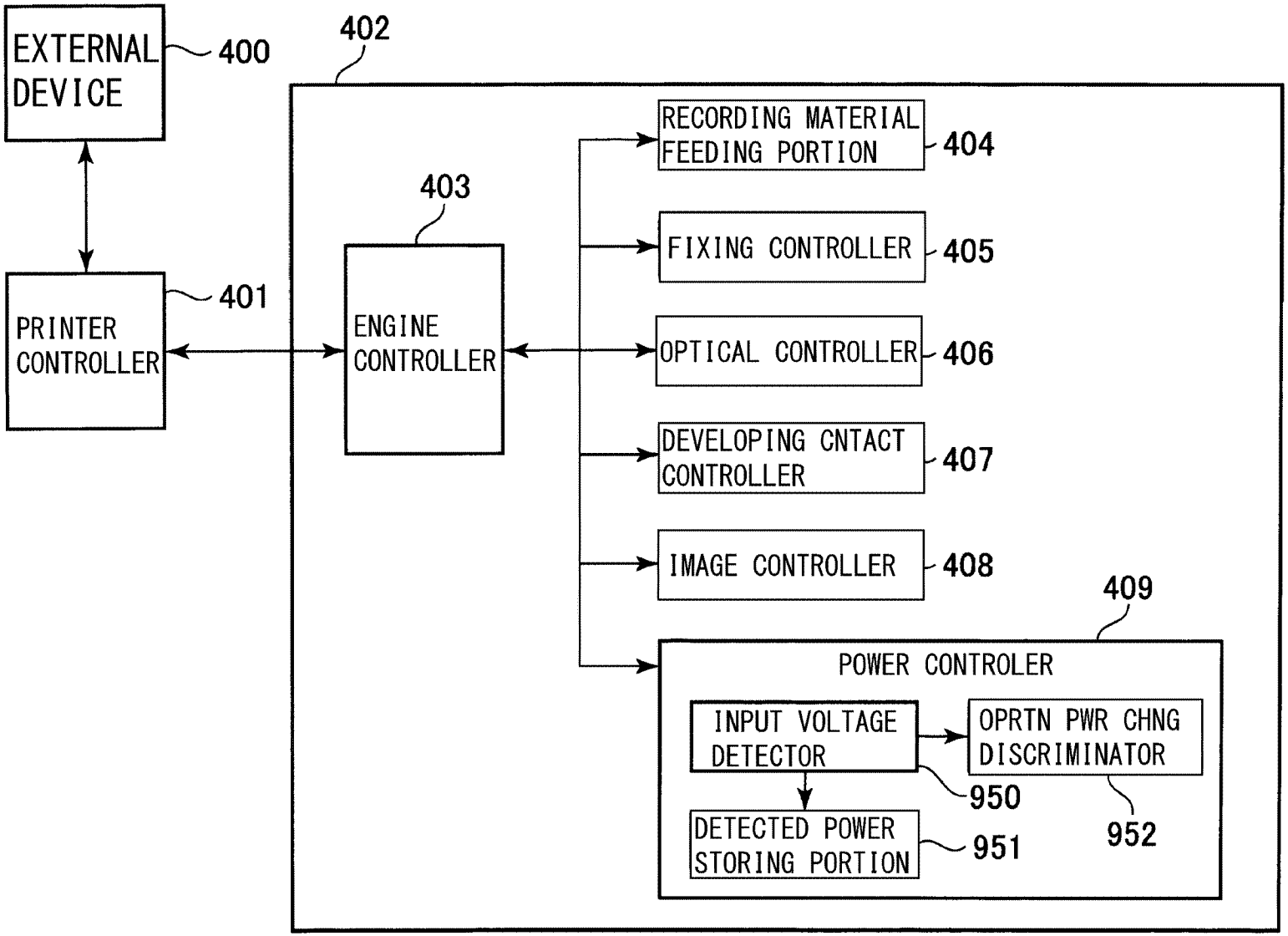

FIG. 16 is a function block diagram showing a system constitution of an image forming apparatus of another embodiment.

Figure 17:
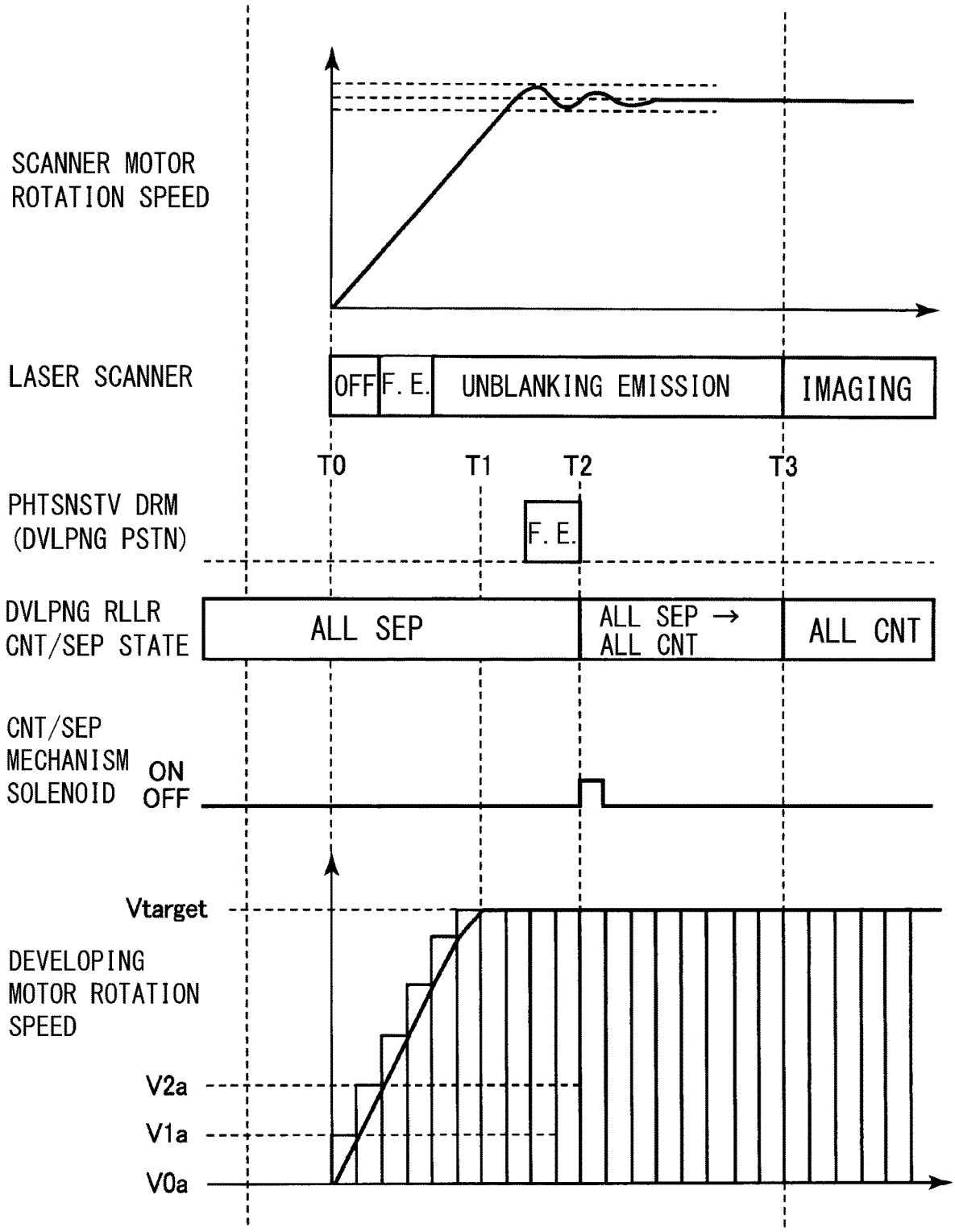

FIG. 17 is a timing chart of an example of a contact operation during a start of a print operation in the case where an input voltage to the image forming apparatus is fluctuated in another embodiment.

Figure 18:
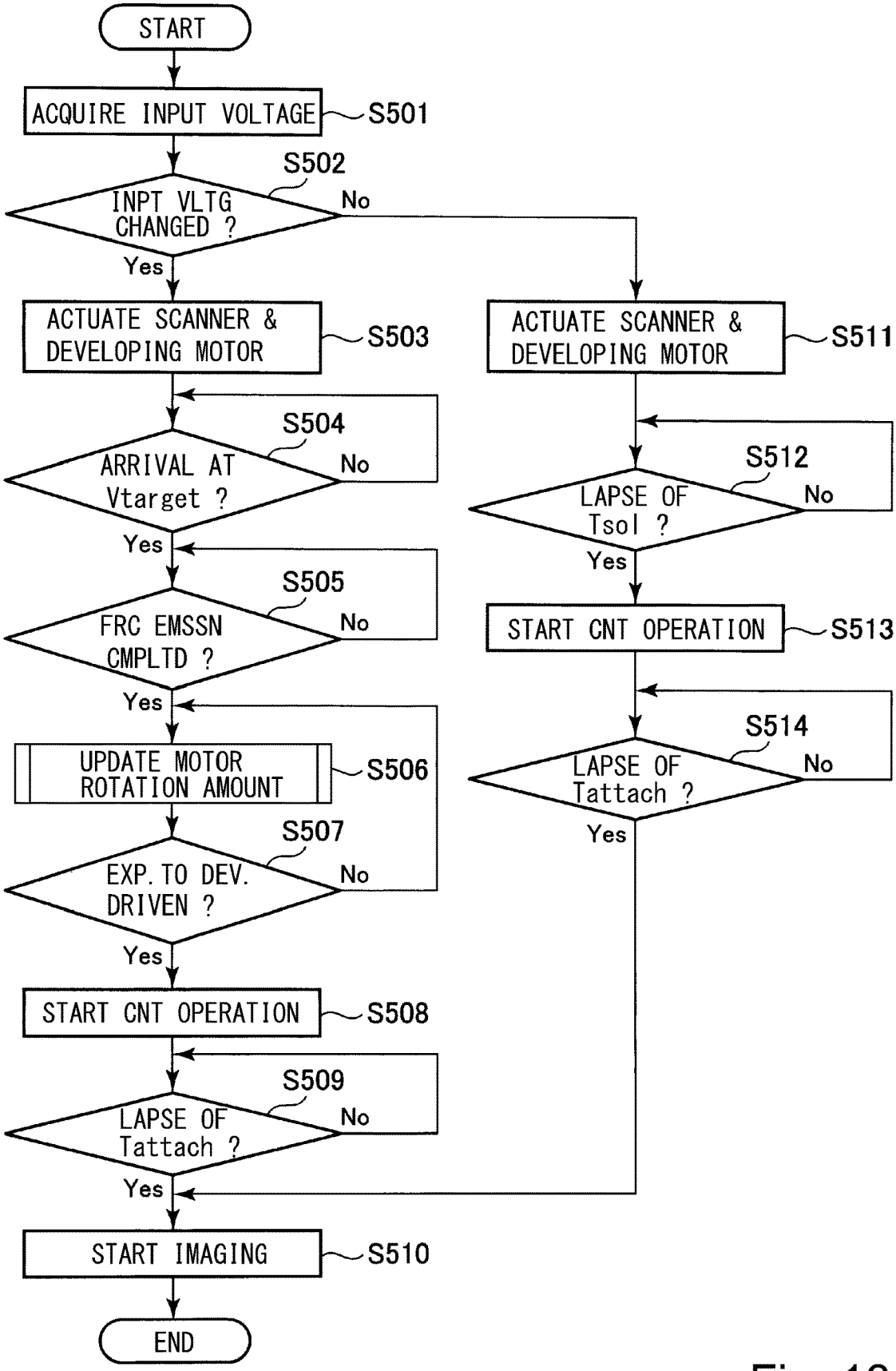

FIG. 18 is a flowchart of an example of the contact operation during the start of the print operation in another embodiment.

DESCRIPTION OF THE EMBODIMENTS

In the following, an image forming apparatus according to the present invention will be described specifically with reference to the drawings.

Figure 1:
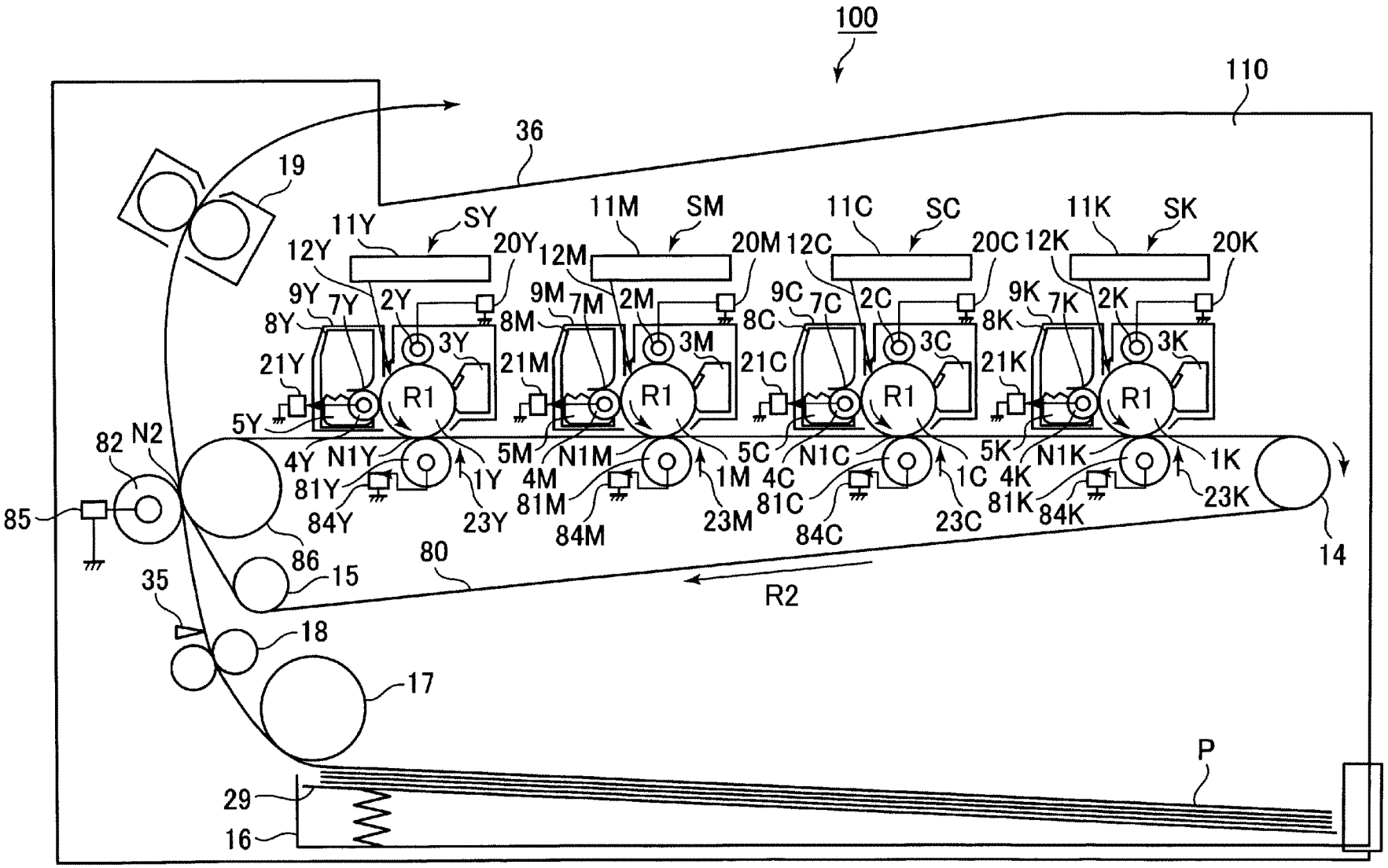
FIG. 1 is a schematic sectional view of an image forming apparatus.

1. Structure and Operation of Image Forming Apparatus and Image Forming Operation FIG. 1 is a schematic sectional view of the image forming apparatus 100 of the embodiment 1. The image forming apparatus 100 of this embodiment is a printer (color image forming apparatus) of a tandem type in which a full-color image is capable of being formed by using an electrophotographic type process and in which an intermediary transfer type process is employed The image forming apparatus 100 includes, as a plurality of image forming portions (stations), first to fourth image forming portions SY, SM, SC and SK for forming images with toners of colors of yellow (Y), magenta (M), cyan (C) and black (K), respectively. These four image forming portions SY, SM, SC and SK are disposed in line with substantially certain intervals along a movement direction of an intermediary transfer belt 13 on an image transfer side (described later). In the embodiment 1, with respect to a movement direction of the intermediary transfer belt 80, the image forming portions for the respective colors are successively disposed from a most upstream side to a most downstream side in the order of yellow (Y), magenta (M), cyan (C) and black (K). As regards elements having the same or corresponding functions or constitutes constitutions provided for the respective colors, these elements are collectively described in some instances by omitting suffixes, Y, M, C and K of reference numerals or symbols representing the elements for associated colors. In this embodiment, the image forming portion is constituted by including a photosensitive drum 1, a charging roller 2, an exposure unit (exposure device) 11, a developing unit 8, a primary transfer roller 81, a drum cleaning device 3, and the like, which are described later.

The image forming portion S includes the photosensitive drum 1 which is a rotatable drum type (cylindrical) photosensitive member (electrophotographic photosensitive member) as a first image bearing member. The photosensitive drum 1 is constituted by a plurality of lamination layers of functional organic materials including a carrier generating layer for generating carrier through sensitization, a charge transporting layer for transporting a generated charge, and the like. An outermost layer thereof is low in electrical conductivity and is almost electrically insulative. During image formation, the photosensitive drum 1 is rotated at a predetermined peripheral speed (process speed) in an arrow R1 direction (counterclockwise direction) in the figure by receiving a driving force from a developing motor (part (b) of FIG. 3), as a driving source, common to the photosensitive drum 1 and a developing roller 4 (described later).

The rotating surface of the photosensitive drum 1 is electrically charged uniformly to a predetermined polarity (negative in the embodiment 1) and a predetermined potential by the charging roller (charging device) 2 which is a roller type charging member as a charging means. The charging roller 2 charges the surface of the photosensitive drum 1 substantially uniformly while being rotated by rotation of the photosensitive drum 1 in contact with the photosensitive drum 1. The charging roller 2 is connected to a charging power source 20 as a charging voltage applying portion. During a charging step, to the charging roller 2, from the charging power source 20, a DC voltage or a superimposed voltage including a DC voltage and an alternating voltage is applied as a charging voltage (charging bias). Then, the charging roller 20 charges the surface of the photosensitive drum 1 by electric discharge generating in at least one of minute air gaps formed on an upstream side and a downstream side of a contact portion between the charging roller 2 and the photosensitive drum 1 with respect to the rotational direction of the photosensitive drum 1.

The charged surface of the photosensitive drum 1 is subjected to scanning exposure to light by the exposure unit 11 as an exposure means (light irradiation means), so that an electrostatic latent image (electrostatic image) is formed on the photosensitive drum 1. The exposure unit 11 is constituted by a scanner unit (light scanning device) for scanning the photosensitive drum surface with laser light by way of a polygon mirror. The exposure unit 11 irradiates the surface of the photosensitive drum 11 with a laser beam 12 modulated on the basis of an image signal, so that the electrostatic latent image depending on the image signal is formed on the photosensitive drum 1. Incidentally, the exposure unit 11 may also be constituted so as to perform light irradiation by an LED array.

The electrostatic latent image formed on the photosensitive drum 1 is supplied with toner as a developer by the developing unit 8 as a developing means and thus is developed (visualized), so that a toner image (developer image) is formed on the photosensitive drum 1. The developing unit 8 is constituted by including a developer container 5, a developing roller 4 as a developing member, and a developer applying blade 7 as a developer regulating member. Non-magnetic one-component developer (toner) is accommodated as the developer in the developer container 5. The developing roller 4 is connected to a developing power source 21 as a developing voltage applying portion. During a developing step, the developing roller 4 is contacted to the photosensitive drum 1. Further, during the developing step, the developing roller 4 receives a driving force from the developing motor 101 (part (b) of FIG. 3) as a driving source and is rotated at a predetermined peripheral speed in the clockwise direction in FIG. 1. Then, during the developing step, to the developing roller 4, from the developing power source 21, a superimposed alternating voltage including a DC voltage and an AC voltage is applied as a developing voltage (developing bias).

By this, the toner is supplied from the developing roller 4 to the photosensitive drum 1 at a developing position (developing portion) where the developing roller 4 and the photosensitive drum 1 are in contact with each other. In the embodiment 1, on an exposure portion (image portion) of the photosensitive drum 1 where an absolute value of a potential is lowered through exposure to light after the uniform charging process, the toner charged to the same polarity (negative in this embodiment) as the normal charge polarity of the photosensitive drum 1 is deposited (reverse development). In this embodiment, the normal charge polarity of the toner which is the charge polarity of the toner during the development is the negative polarity. A DC component of the developing voltage has the same polarity (negative in this embodiment) as the normal charge polarity of the toner. Further, the potential of the DC component of the developing voltage is set at a potential between a surface potential (charge potential) of a non-image portion (non-exposure portion) on the photosensitive drum 1 charged uniformly and a surface potential of an image portion (exposure portion) where an absolute value of the potential is lowered by the exposure to light.

The intermediary transfer belt 80 which is an intermediary transfer member constituted by an endless belt as a second image bearing member is disposed so as to oppose the photosensitive drums 1Y, 1M, 1C and 1K. The intermediary transfer belt 80 is supported by three rollers, as stretching members, consisting of a secondary transfer opposite roller 86, a driving roller 14, and a tension roller 15, and proper tension is maintained. The driving roller 14 is rotated in the clockwise direction in FIG. 1 by receiving the driving force from the driving source (not shown), so that the intermediary transfer belt 80 is rotated (circulated and moved) in an arrow R2 direction (clockwise direction) in FIG. 1. The intermediary transfer belt 80 is moved at the substantially same speed in the same direction as those of the photosensitive drum 1 at an opposing portion to the photosensitive drum 1. On an inner peripheral surface side of the intermediary transfer belt 80, correspondingly to the photosensitive drums 1Y, 1M, 1C and 1K, the primary transfer rollers 81Y, 81M, 81C and 81K which are roller-type primary transfer members as primary transfer means are disposed, respectively. Each of the primary transfer rollers 81 is disposed at a position opposing the photosensitive drum 1 via the intermediary transfer belt 80 and is rotated with movement of the intermediary transfer belt 80 in contact with the inner peripheral surface of the intermediary transfer belt 80. The primary transfer roller 81 is contacted to the photosensitive drum 1 via the intermediary transfer belt 80 and is urged toward the photosensitive drum 1, so that a primary transfer portion (primary transfer nip) N1 where the photosensitive drum 1 and the intermediary transfer belt 80 are in contact with each other is formed. The primary transfer rollers 81Y, 81M, 81C and 81K are connected to primary transfer power sources 84Y, 84M, 84C and 84K, respectively, as primary transfer voltage applying portions. Further, with respect to the rotational direction of the intermediary transfer belt 80, on a downstream side of the primary transfer rollers 81Y, 81M, 81C and 81K, charge removing members 23Y, 23M, 23C and 23K are disposed, respectively. Incidentally, the driving roller 14, the tension roller 15, the secondary transfer opposite roller 86, and the charge removing members 23Y, 23M, 23C and 23K are electrically grounded (connected to the ground). As described above, the toner image formed on the photosensitive drum 1 is transferred (primary-transferred) onto the rotating intermediary transfer belt 80 by the action of the primary transfer roller 81 in the primary transfer nip N1. During a primary transfer step, to the primary transfer roller 81, a primary transfer voltage (primary transfer bias) which is a DC voltage of a polarity (positive in this embodiment) opposite to the normal charge polarity of the toner is applied from a primary transfer power source 84. For example, during full-color image formation, toner images of yellow, magenta, cyan and black formed on the respective photosensitive drums are successively primary-transferred superposedly onto the intermediary transfer belt 80.

On an outer peripheral surface side of the intermediary transfer belt 80, at an opposing position to the secondary transfer opposite roller 86, a secondary transfer roller 82 which is a roller-type secondary transfer member as a secondary transfer means is disposed. The secondary transfer roller 82 is rotated with movement of the intermediary transfer belt 80 in contact with the outer peripheral surface of the intermediary transfer belt 80. The secondary transfer roller 82 is contacted to the secondary transfer opposite roller 86 via the intermediary transfer belt 80 and is urged toward the secondary transfer opposite roller 86, so that a secondary transfer portion (secondary transfer nip) N2 where the intermediary transfer belt 80 and the secondary transfer roller 82 are in contact with each other is formed. The secondary transfer roller 82 is connected to a secondary transfer power source 85 as a secondary transfer voltage applying portion. As described above, the toner image formed on the intermediary transfer belt 80 is transferred (secondary-transferred) onto the recording material P fed while being nipped between the intermediary transfer belt 80 and the secondary transfer roller 82 by the action of the secondary transfer roller 82 in the secondary transfer portion N2. During a secondary transfer step, to the secondary transfer roller 82, a secondary transfer voltage (secondary transfer bias) which is a DC voltage of the polarity (positive in this embodiment) opposite to the normal charge polarity of the toner is applied from a secondary transfer power source 85.

The recording material (recording medium, transfer material, sheet) P such as paper or a plastic sheet is accommodated in a recording material cassette 16 as a recording material accommodating portion, and is fed from the recording material cassette 16 and is supplied to the secondary transfer portion N2. When the recording material P is fed from the recording material cassette 16, a pick-up roller 17 as a feeding member is driven by a feeding motor (not shown) constituted by a stepping motor. With this drive, a bottom plate 29 provided in the recording material cassette 16 is raised, so that the recording material P stacked in the recording material cassette 16 is pushed up. By this, an uppermost (one) recording material P of the recording materials P stacked in the recording material cassette 16 is contacted to the pick-up roller 17 and is sent from the recording material cassette 16 by rotation of the pick-up roller 17. This recording material P is conveyed to a registration roller pair 18 as a conveying member. Further, when a leading end of the recording material P with respect to a feeding direction is detected by a registration sensor 35 as a recording material detecting means, the drive of the feeding motor is stopped, and feeding of the recording material P is once stopped. Then, this recording material P is conveyed to the secondary transfer portion N2 by the registration roller pair 18 at a predetermined timing in synchronism with the movement of the toner image on the intermediary transfer belt 80.

The recording material P on which the toner image is transferred is conveyed to a fixing device 19 as a fixing means. The fixing device 19 is constituted, for example, by including a fixing film as a heating member and a pressing roller as a pressing member. The fixing device 19 applies heat and pressure to the recording material P carrying thereon an unfixed toner image, so that the toner image is fixed (melted, stack) on the recording material P. The recording material P on which the toner image is fixed is then discharged (outputted) to an outside of an apparatus main assembly 110 of the image forming apparatus 100, and is stacked on a discharge tray 36 provided at an upper portion of the apparatus main assembly.

On the other hand, a deposited matter such as primary transfer residual toner remaining on the photosensitive drum 1 after the primary transfer is removed and collected from the surface of the photosensitive drum 1 by the cleaning device 3 as a cleaning means. In this embodiment, the cleaning device 3 is constituted by a cleaning blade as a cleaning member contacting the photosensitive drum 1 and a cleaning container for accommodating the toner or the like removed from the photosensitive drum 1 by the cleaning blade. A deposited matter such as the secondary transfer residual toner remaining on the intermediary transfer belt 80 after the secondary transfer is removed and collected from the surface of the intermediary transfer belt 80 by an intermediary transfer member cleaning means (not shown).

Here, with respect to the rotational direction of the photosensitive drum 1, a position on the photosensitive drum 1 where the charging process is performed by the charging roller 2 is a "charging position". As described above, in this embodiment, the photosensitive drum 1 is charged by the electric discharge generating in the gaps formed upstream and downstream of the contact portion between the charging roller 2 and the photosensitive drum 1, but the contact portion between the charging roller 2 and the photosensitive drum 1 may be considered as the charging position. Further, with respect to the rotational direction of the photosensitive drum 1, a laser light irradiation position on the photosensitive drum 1 by the exposure unit 11 is an "exposure position", and a position on the photosensitive drum 1 where the developing roller 4 contacts the photosensitive drum 1 is a "developing position".

In the embodiment 1, the photosensitive drum 1, and as process means actable on the photosensitive drum 1, the charging roller 2, the developing unit 8, and the cleaning device 3 integrally constitute a process cartridge 9 detachably mountable to the apparatus main assembly 110. Incidentally, the constitution of the cartridge is not limited to this. For example, the photosensitive drum 1 (which may further include the charging roller 2 and the cleaning device 3) can be used as one cartridge (drum cartridge), and the developing unit 8 can be used as another cartridge (developing cartridge).

Further, in this embodiment, the image forming apparatus 100 is capable of executing image formation in a full-color mode (first image forming mode) and a monochromatic mode (second image forming mode) as an image forming mode. In an operation in the full-color mode, the toner images are formed in all the four image forming portions 8Y, SM, SC and SK, so that a full-color image can be formed and outputted. In an operation in the monochromatic mode, the toner image is formed only in the image forming portion SK for the black of the four image forming portions SY, SM, SC and SK, so that a black (monochromatic) image can be formed. During the image formation in the full-color mode, the developing rollers 5 are contacted to the photosensitive drums 1 in all the four image forming portions SY, SM, SC and SK, so that the photosensitive drums 1 and the developing rollers 4 are driven, and then, the charging voltage, the developing voltage, and the primary transfer voltage are applied. In the operation in the monochromatic mode, the developing roller 4 is contacted to the photosensitive drum 1 only in the image forming portion SK for black of the four image forming portions SY, SM, SC and SK, and the photosensitive drum 1 and the developing roller 4 are driven, and then, the charging voltage, the developing voltage, and the primary transfer voltage are applied.

2. System Constitution of Image Forming Apparatus

Figure 2:
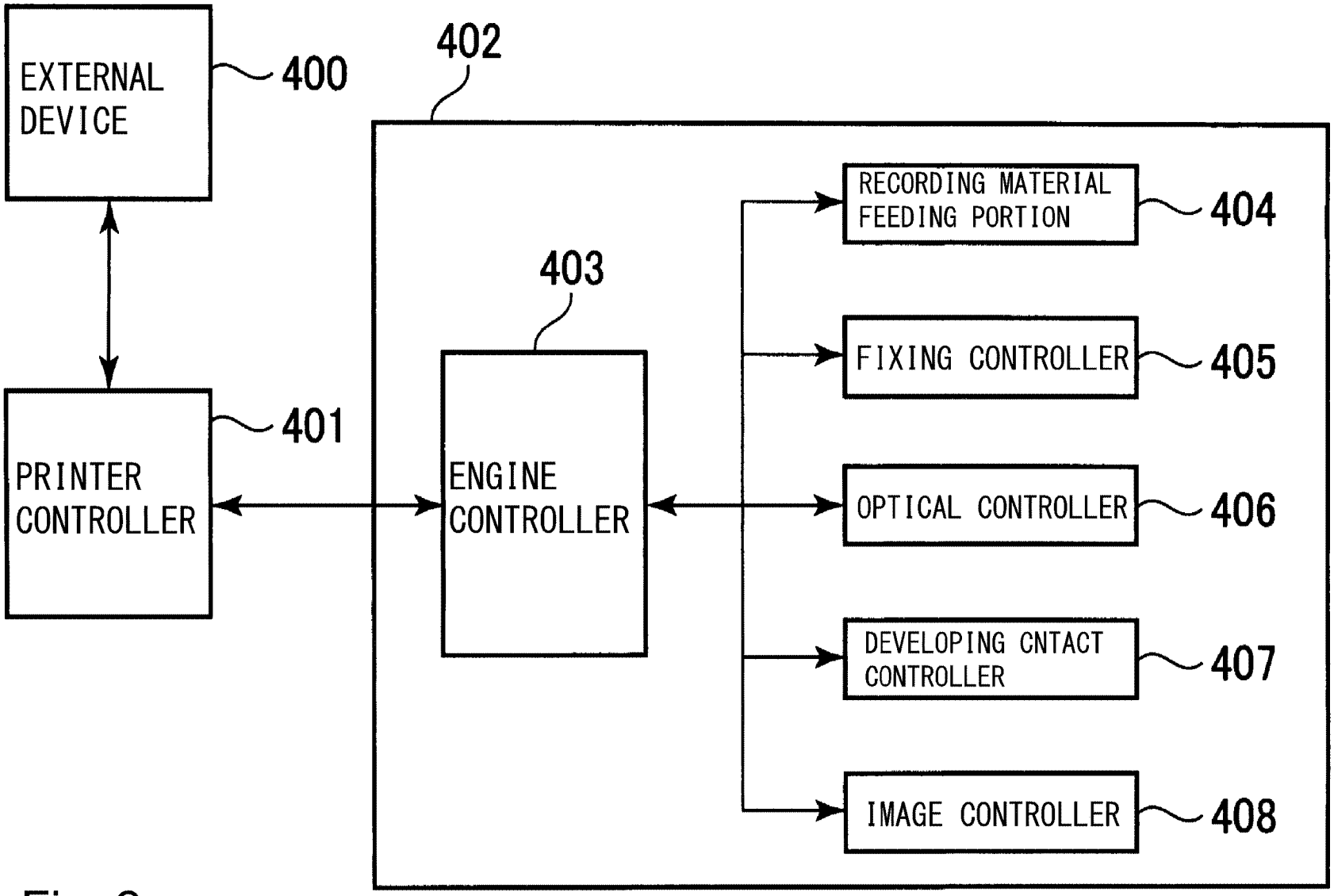
FIG. 2 is a function block diagram showing a system constitution of the image forming apparatus.

FIG. 2 is a functional block diagram for illustrating a system constitution of the image forming apparatus 100.

The image forming apparatus 100 is provided with a printer controller 401. The printer controller 401 is constituted by including a microcomputer. The printer controller 401 receives code data sent from an external device 400 such as a host computer and develops and processes the code data into bit map data (image data) and print information (various pieces of setting information) necessary to form the image(s). Further, the printer controller 401 also has a function of performing a process for displaying inside information of the image forming apparatus 100 at a display portion of an operating portion provided on the image forming apparatus 100 and at a display portion of the external device 400.

Further, the image forming apparatus 100 is provided with an engine controller 403. The engine controller 403 controls operations of respective portions of the image forming apparatus 100 in accordance with an instruction of the printer controller 401. The operations of the respective portions of the image forming apparatus 100 include formation of the electrostatic latent image on the photosensitive drum 1, development of the electrostatic latent image, primary transfer and secondary transfer of the toner image, fixing of the photosensitive drum 1 on the recording material P, a feeding operation of the recording material P, and the like operation. Further, the engine controller 403 notifies the printer controller 401 of the inside information of the image forming apparatus 100 indicating states of the respective portions of the image forming apparatus 100. The engine contact 403 and the respective portions of the image forming apparatus 100 which are controlled by the engine controller 403 constitute a print engine 402.

The engine controller 403 is constituted by including a CPU as a control means, memories (ROM, RAM, and the like) as storing means in which various pieces of control information are stored, and an input/output portion (I/F) for controlling transfer of signals between the engine controller 403 and each of the respective portions. The engine controller 403 is constituted by, for example, a one-chip microcomputer in which the ROM, the RAM, and the like are incorporated. The engine controller 403 is capable of receiving and sending the information between itself and the printer controller 401 through, for example, serial communication. Further, the engine controller 403 controls the respective portions of the image forming apparatus 100 in accordance with the instructions of the printer controller 401. The respective portions include a recording material feeding portion 404, a fixing controller 405, an optical controller 406, a developing (roller) contact controller 407, and an image controller 408.

The engine controller 403 awaits until receives a print instruction (print operation start instruction) from the printer controller 401. Then, the engine controller 403 controls the respective controllers when receives the print instruction, and then starts a print operation. When the image controller 408 receives the print instruction, in a preparatory operation, the image controller 408 discriminates whether the image forming mode is the full-color mode or the monochromatic mode on the basis of the information received from the printer controller 401. Then, depending on a designated image forming mode, the developing contact controller 407 executes a contact and separation operation (contact and separation state switching operation) so as to switch a contact and separation state between the photosensitive drum 1 and the developing roller 4 in the image forming portion S for each of the colors.

The image controller 408 discriminates whether or not the timing becomes an image forming timing, and sends, to the engine controller 403, information on the image forming timing. When the engine controller 403 receives, from the image controller 408, a signal indicating that the timing became the image forming timing, the engine controller 403 sends, to the printer controller 401, an image synchronizing signal ("TOP signal") indicating a reference timing of output of a video signal as image data.

When the printer controller 401 receives the image synchronizing signal from the engine controller 403, the printer controller 401 outputs a video signal on the basis of the color designated by reference color designation. When the recording material feeding portion 404 receives the print instruction, the recording material feeding portion 404 starts feeding and conveying operations of the recording material P. When the fixing controller 405 receives the print instruction, the fixing controller 405 starts preparation of the fixing. The fixing controller 405 starts temperature control of the fixing device 19 in accordance with information on a print reservation command and in synchronism with a timing when the recording material P subjected to the secondary transfer is conveyed to the fixing device 19, and fixes the toner image on the recording material P. The optical controller 406 will be described later.

Incidentally, in FIG. 2, the respective controllers 404 to 408 are shown separately from the engine controller 403, but the engine controller 403 may have a part of functions (which may be a function of each of the controllers) of the controllers 404 to 408 or all of the functions of the controllers 404 to 408.

3. Contact and Separation Operation of Developing Roller

Next, a contact and separation operation between the photosensitive drum 1 and the developing roller 4 in which a contact and separation state between the photosensitive drum 1 and the developing roller 4 (herein, this state is also simply referred to as a "contact and separation state of the developing roller", and this contact and separation operation is also simply referred to as a "contact and separation operation of the developing roller") will be described.

Part (a) of FIG. 3 is a sectional view of the process cartridge 9 in the embodiment 1. Incidentally, the constitutions of the process cartridges 9Y, 9M, 9C and 9K for the respective colors are substantially the same except that the colors of the toners accommodated in the developing containers 5 are different from each other. Part (b) of FIG. 3 is a schematic view of a contact and separation unit (contact and separation mechanism) 500 for switching the contact and separation state of the developing roller 4 in the embodiment 1.

In this embodiment, the photosensitive drum 1 and the developing roller 4 are rotated by receiving a driving force from a developing motor 101 (part (b) of FIG. 3), as a driving source, which is common to the photosensitive drum 1 and the developing roller 4. The photosensitive drum 1 is rotated in an arrow R1 direction (counterclockwise direction) in part (a) of FIG. 3 at a predetermined peripheral speed. Further, the developing roller 4 is rotated in an arrow R3 direction (clockwise direction) in part (a) of FIG. 3 at a predetermined peripheral speed. That is, the photosensitive drum 1 and the developing roller 4 are rotated so as to move in the same direction at a contact portion therebetween. A rotational axis of the photosensitive drum 1 and a rotational axis of the developing roller 4 are substantially parallel to each other.

Incidentally, as described later, in this embodiment, the developing motor 101 is used not only as the common driving source for the developing roller 4 and the photosensitive drum 1 but also a driving source for the contact and separation unit 500.

As shown in part (a) of FIG. 3, the process cartridge 9 includes a drum unit 13 and a developing unit (developing device) 8. The drum unit 13 is constituted such that the photosensitive drum 1, the charging roller 2 and the cleaning device 3 are supported by a drum unit frame 93. The developing unit 8 is constituted such that the developing roller 4 and a developer application blade 7 are supported by the developing container (developing frame) 5. The developing unit 8 (developing container 5) is mounted to the drum unit frame 93 so as to be rotatable (switchable) about a rotational axis 94 substantially parallel to a rotational axis of the photosensitive drum 1. Further, the developing unit 8 (developing container 5) is urged by an urging spring 91 which is an elastic member as an urging means so that the developing roller 4 is rotated in a direction in which the developing roller 4 is contacted to the photosensitive drum 1. Further, at each of end portions of the developing unit 8 (developing container 5) with respect to a rotational axis direction (longitudinal direction) of the developing roller 4, a receiving portion 92 for receiving a force from the contact and separation unit 500 (described later) is provided. In the developing unit 8 (developing container 5), a predetermined force is imparted to the receiving portion 92 by a slider 506 (506 for 506*r*) of the contact and separation unit 500, whereby the developing roller 4 is rotated against an urging force of the urging spring 91 in a direction in which the developing roller 4 is separated (spaced) from the photosensitive drum 1. Thus, the developing roller 4 is put in a contact state in which the developing roller 4 is contacted to the photosensitive drum 1 by releasing the force imparted to the receiving force, and is put in a separated state in which the developing roller 4 is separated from the photosensitive drum 1 by imparting the force to the receiving portion 92.

As shown in part (b) of FIG. 3, the contact and separation unit 500 includes an input gear 501, a partially-toothless gear mechanism 502, a solenoid (electromagnetic solenoid, flapper solenoid) 503, and an output portion 504. Further, the contact and separation unit 500 includes a first contact and separation cam 505*f*, a second contact and separation cam 505*m*, a first slider 506*f*, a second slider 506*m*, a sensor flag 507, and an HP (home position) sensor 508. The input gear 501 is a drive transmitting member for inputting the driving force from the developing motor 101 as the driving source to the contact and separation unit 500. The partially-toothless gear mechanism 502 is a drive transmitting member for drive transmission from the input gear 501 to the output portion 504 or for releasing the drive transmission. The solenoid 503 is a switching member (drive transmission switching member) for switching a state of the partially-toothless gear mechanism 502 between a drive transmission state and a drive-transmission-released state. The first contact and separation cam 505*f* is a switching member (contact and separation state switching member) for switching a contact and separation state of the developing roller 4 in each of the image forming portions S for the colors of yellow, magenta, and cyan. The second contact and separation cam 505*m* is a switching member (contact and separation state switching member) for switching a contact and separation state of the developing roller 4 in the image portion S for black. The first slider 506*f* is a movable member moved by the first contact and separation cam 505*f* for imparting the force to the receiving portion 92 of each of the developing units 8 for the colors of yellow, magenta and cyan. The second slider 506*m* is a movable member moved by the second contact and separation cam 505*m* for imparting the force to the receiving portion 92 of the developing unit 8 for black.

As a constitution for switching the state of the partially-toothless gear mechanism 502 between the drive transmission state and the drive-transmission-released state by the partially-toothless gear mechanism 502 and the solenoid 503, a well-known one can be appropriately used. Accordingly, although detailed description of this constitution will be omitted, this constitution is generally as follows. The partially-toothless gear mechanism 502 includes a first partially-toothless gear, a second partially-toothless gear, and a locking claw, and these three members are coaxially arranged in parallel in an axial direction. The solenoid 503 is constituted by including a locking stopper capable of retaining the locking claw in engagement with the locking claw. The solenoid 503 release the retention of the locking claw by the locking claw stopper when a current is supplied to the solenoid 503. When the locking claw stopper retains the locking claw, toothless portions of the first partially-toothless gear and the second partially-toothless gear oppose the input gear 501, so that the driving force of the input gear 501 is not transmitted. Further, the solenoid 503 engages with the locking claw by the locking claw stopper thereof when the supply of the current is cut off, and thus retains the locking claw. When the retention of the locking claw by the locking claw stopper is released by supplying the current to the solenoid 503, the second partially-toothless gear coaxial with the locking claw is rotated by the action of a spring provided between itself and the first partially-toothless gear. Then, the second partially-toothless gear engages with the input gear 501, and is rotated by the driving force from the input gear 501. Further, when the second partially-toothless gear is rotated, the first partially-toothless gear is also rotated by engagement between an engaging portion provided on the second partially-toothless gear and a portion-to-be-engaged provided on the first partially-toothless gear.

Then, the first partially-toothless gear also engages with the input gear 501, and is rotated by the driving force from the input gear 501. By this drive transmission from the input gear 501 to the output portion (output gear, output shaft, or the like) 504 is established via the first partially-toothless gear and the second partially-toothless gear. Further, when the second partially-toothless gear is rotated, supply of a current to the solenoid 503 is cut off, so that a state in which the locking claw is capable of being held by the locking claw stopper is formed. Then, when the second partially-toothless gear is rotated by a predetermined phase (for example, one full circumference), the locking claw stopper engages with the locking claw again and thus holds the locking claw. At this time, a toothless portion of the second partially-toothless gear opposes the input gear 501. Further, when the first partially-toothless gear is also rotated by a predetermined phase (for example, one full circumference), a toothless portion thereof opposes the input gear 501 and rotation thereof stops.

In a period until the first partially-toothless gear stops, a spring provided between the first partially-toothless gear and the second partially-toothless gear is compressed. By this, the input gear 501 opposes the toothless portions of the first and second partially-toothless gears and idles, so that drive transmission from the input gear 501 toward the output portion 504 via the first and second partially-toothless gears is released.

The contact and separation unit 500 intermittently performs the drive transmission toward the output portion 504 as desired. This intermittent drive transmission is performed by the partially-toothless gear mechanism 502 and the solenoid 503. The output portion 504 operates by a predetermined phase every rotation of the partially-toothless gear mechanism 502 (the first and second partially-toothless gears) by a predetermined phase (for example, one full circumference). A contact and separation state of the developing roller 4 of the image forming apparatus S for the associated color is switched by the first contact and separation cam 505*f* and the second contact and separation cam 505*m* which are fixed coaxially with the output portion 504. The contact and separation cam 505*f* and the second contact and separation cam 505*m* reciprocate the first slider 506*f* and the second slider 506*m*, respectively, moved by rotations of these cams, respectively. Then, by the first slider 506*f*, impartment of the force to the receiving portions 92 of the developing units 8 for the colors of yellow, magenta, and cyan and release of the impartment of the force are switched. Further, by the second slider 506*m*, impartment of the force to the receiving portion 92 of the developing unit 8 for black and release of the impartment of the force are switched. By this, the contact and separation state of the developing roller 4 in each of the image forming portions is switched. Thus, in the embodiment 1, by operating the solenoid 503, whether the first and second contact and separation cams 505*f* and 505*m* are operated or operation-stopped. In the case where the solenoid 503 is not operated, the input gear 501 for inputting the driving force to the first and second contact and separation cams 505*f* and 505*m* is idled. Further, in the case where the solenoid 503 is driven, the locking claw stopper of the solenoid 503 is disengaged from the locking claw of the partially-toothless gear mechanism 502, so that the input gear 501 drives the first and second contact and separation cams 505*f* and 505*m*. When the input gear 501 is rotated by a predetermined rotation amount, the locking clear stopper is abutted against the locking claw again, so that the input gear 501 is continuously idled.

In the embodiment 1, every time when the partially-toothless gear mechanism 502 (the first and second partially-toothless gears) is rotated one full circumference by driving the solenoid 503 one full circumference, the output portion (output gear, output shaft, or the like) 504 is rotated by ⅓ rotation (120°) in one direction. With this rotation of the output portion 504, each of the first contact and separation cam 505*f* and the second contact and separation cam 505*m* is rotated by ⅓ rotation (120°). each of the first contact and separation cam 505*f* and the second contact and separation cam 505*m* is rotated by ⅓ rotation, whereby the contact and separation state of the developing roller(s) 4 in the associated image forming portion(s) S is successively switched between an all-separation state, an all-contact state, and a single contact state. That is, a cam profile of the first and second contact and separation cams 505*f* and 505*m* is set so that such switching is carried out.

Further, the sensor flag 507 is fixed coaxially with the first and second contact and separation cams 505*f* and 505*m*. Further, the HP sensor 508 is provided so as to detect a phase (position with respect to the rotational direction) of this sensor flag 507, i.e., phases of the first and second contact and separation cams 505*f* and 505*m*. The sensor flag 507 has a disk shape and is partially provided with a slit, for example, so that detection light of the HP sensor 508 constituted by a photo-interrupter is caused to pass through a slit portion and is blocked at a portion other than the slit portion. In the embodiment 1, the sensor flag 507 transmits the detection light of the HP sensor 508 in the all-separation state (described later). By this, the HP sensor 508 is capable of detecting that the contact and separation states of the developing rollers 4 of the image forming portions S for the respective colors are in the all-separation state (described later).

Incidentally, the first contact and separation cam 505*f* and the second contact and separation cam 505*m* may be provided integrally with each other. Further, the sensor flag 507, and the first contact and separation cam 505*f* or the second contact and separation cam 505*m* may be provided integrally with each other.

Parts (a) to (c) of FIG. 4 are schematic views each showing the contact and separation states of the developing rollers 4 in the image forming portions for the respective colors. Part (a) of FIG. 4 shows the all-separation state (all separation position) in which the developing rollers 4 are separated (spaced) from the photosensitive drums 1 in all the four image forming portions SY, SM, SC and SK. Part (b) of FIG. 4 shows the all-contact state (all contact position) in which the developing rollers 4 are contacted to the photosensitive drums 1 in all the four image forming portions SY, SM, SC and SK. Part (c) of FIG. 4 shows the single contact state (signal contact position) in which the developing roller 4 is contacted to the photosensitive drum 1 only in the image forming portion SK for black of the four image forming portions SY, SM, SC and SK. In the embodiment 1, the contact and separation state of the developing roller 4 in each of the image forming portions for the respective colors is put in the all-separation state in a stand-by state in which the image forming apparatus 100 stands by for input of a print instruction or in an OFF state of a power source. Further, the contact and separation states of the developing rollers 4 are put in the all-contact state during the image formation in the operation in the full-color mode. Further, the contact and separation states of the developing rollers 4 are put in the single contact state during the image formation in the operation in the monochromatic mode. Incidentally, as described above, in the embodiment 1, the HP sensor 803 is capable of detecting the contact and separation states of the developing rollers 4 in the image forming portions S for the respective colors by using the all-separation state as a reference state (reference position).

From the all-separation state of part (a) of FIG. 4, the force imparted to the receiving portions 92 of the developing units 8 for the respective colors is released, so that the developing roller contact and separation state is put in the all-contact state of part (b) of FIG. 4. A rotation amount of the developing motor 101 required for switching the developing roller contact and separation state from the all-separation state (part (a) of FIG. 4) to the all-contact state (part (b) of FIG. 4) is referred to as "Dfull". From the all-contact state of part (b) of FIG. 4, the force is imparted to the receiving portions 92 of the developing units 8 for yellow, magenta and cyan by the first slider 506*f*, so that the associated developing rollers 4 are separated from the photosensitive drums 1 and thus the single contact state of part (c) of FIG. 4 is formed. A rotation amount of the developing motor 101 required for switching the developing roller contact and separation state from the all-contact state (part (b) of FIG. 4) to the single contact state (part (c) of FIG. 4) is referred to as "Dmono".

Further, from the single contact state of part (c) of FIG. 4, the force is imparted to the receiving portion 92 of the developing unit 8 for black by the second slider 506*m*, so that the developing roller 4 for black is separated from the photosensitive drum 1 and thus the all-separation state of part (a) of FIG. 4 is formed. A sensor amount of the developing motor 101 required for switching the developing roller contact and separation state from the single contact state (part (c) of FIG. 4) to the all-separation state (part (a) of FIG. 4) is referred to as "Doff". Thus, in this embodiment, the contact and separation unit 500 is constituted so as to perform a switching operation of the contact and separation state of an all-state transition type by subjecting the states of parts (a) to (c) of FIG. 4 to successive transition.

Incidentally, in this embodiment, as the developing motor 101, a motor for carrying out sensor-less vector control is employed, so that a rotational speed of the motor can be detected (estimated) on the basis of a current value of the current supplied to the motor. However, the present invention is not limited to such a constitution, and if there is a means for detecting (estimating) the rotational speed of the motor, a motor with another constitution, such as a brushless motor may be used.

4. Developing Contact Controller

FIG. 5 is a functional block diagram of the developing contact controller 407 in the embodiment 1. The developing contact controller 407 includes the following portions and is operated on the basis of an instruction from the engine controller 403.

That is, the developing contact controller 407 includes, as functional blocks, a drive controller 910, a contact and separation portion 911, a driving speed detecting portion 912, and a speed acquisition interval storing portion 916. Further, the developing contact controller 407 includes, as the functional blocks, a rotation amount estimating portion 913, a rotation amount storing portion 914, a contact and separation state discriminating portion 915, a time storing portion 917, and a contact operation start discriminating portion 918.

The drive controller 910 controls the drive of the developing motor 101. The contact and separation portion 911 operates the first and second contact and separation cams 505*f* and 505*m* by driving the solenoid 503 when the developing motor 101 is driven, and thus switches the contact and separation state of the developing roller 4 in each of the image forming portions S for the respective colors. The driving speed detecting portion 912 detects the rotational speed of the developing motor 101. The rotation amount estimating portion 913 estimates (calculates) a short-term rotation amount of the developing motor 101 on the basis of the rotational speed of the developing motor 101 detected by the driving speed detecting portion 912 and a speed acquisition interval (detection interval) stored in the speed acquisition interval storing portion 916. The rotation amount storing portion 914 integrates the short-term rotation amount of the developing motor 101 estimated by the rotation amount estimating portion 913 and stores the integrated value. The contact and separation state discriminating portion 915 discriminates whether or not the transition of the contact and separation state is completed, on the basis of information on a rotation amount of the developing motor 101 necessary for the transition between the respective contact and separation states stored in the contact and separation portion 911 and a rotation amount of the developing motor 101 stored in the rotation amount storing portion 914.

The time storing portion 917 stores information on various times (timings) relating to the contact operation of the developing roller 4, such as a contact completion time (described later). Further, the contact operation start discriminating portion 918 determines a contact operation start timing (described later) on the basis of information or the like stored in the time storing portion 917, and then carries out control on a start of the contact operation of the developing roller 4.

Incidentally, in the following description, for simplification, the above-described operations (processes) by the respective functional blocks of the developing contact controller 407 are described as operations (processes) of the developing contact controller 407 or the engine controller 403 providing the instruction to the developing contact controller 407 in some instances.

5. Exposure Unit

FIG. 6 is a schematic view of the exposure unit (scanner unit) 11 in the embodiment 1. Incidentally, constitutions of the exposure units 11 for the image forming portions S for the respective colors are substantially the same. Further, a part of the constitution of the exposure unit 11 may be common to the plurality of the image forming portions S.

A laser driving system circuit 130 goes into action depending on a light emission level set by the engine controller 403. By this, a drive current flows through a laser diode 107 which is a light emitting element (light source). The laser diode 107 emits laser light at an intensity level depending on the drive current. The laser light emitted by the laser diode 107 is rectified in beam shape and made a collimated beam by a collimator lens 134, and the photosensitive drum 1 is scanned with the laser light through a polygon mirror 133 in a horizontal direction (rotational axis direction, main scan direction). Then, the laser light with which the photosensitive drum 1 is scanned through the polygon mirror 133 is formed, by an fθ1 lens 132, on the surface of the photosensitive drum 1 rotating about a rotation shaft in an arrow R1 direction in FIG. 6. By this, the surface of the photosensitive drum 1 is exposed to light in a dot shape. On the other hand, a reflection mirror 131 is provided correspondingly to a scanning position on one end side with respect to the rotational axis direction of the photosensitive drum 1. The reflection mirror 131 reflects the laser light, to be incident on a scanning start position of the photosensitive drum 1, toward a BD sensor (beam detection sensor) 121. Further, on the basis of an output of the BD sensor 121, a start timing of the scanning with the laser light is determined.

6. Optical Controller

FIG. 7 is a block diagram showing functional blocks of the optical controller 406 and hardware 600 controlled by the optical controller 406 in the embodiment 1.

The optical controller 406 includes the following portions and is operated on the basis of an instruction from the engine controller 403. That is, the optical controller 406 includes, as the functional blocks, a scanning portion 612, a scanner motor controller 610, a laser light quantity switching portion 611, a BD detecting portion 613, and a scanner motor speed detecting portion 614. Further, the optical controller 406 controls an operation (including acquisition of a detection signal of the hardware 600 including a scanner motor 630, the laser drive system circuit 130, the laser diode 107, the BD sensor 121, and the polygon mirror 133.

The scanning portion 612 controls the scanner motor 630 as a driving source for the polygon mirror 133 on the basis of information (signal) from the BD sensor 121. Specifically, the BD detecting portion 613 detects a BD signal on the basis of the information (signal) acquired from the BD sensor 121, and then the scanner motor speed detecting portion 614 detects a rotational speed of the scanner motor 630 on the basis of the BD signal detected by the BD detecting portion 613. On the basis of the rotational speed of the scanner motor 630 detected by the scanner motor speed detecting portion 614, the scanning portion 612 causes the scanner motor controller 610 to control the scanner motor 630 so that the rotational speed of the scanner motor 630 is stabilized at a target speed. That is, the scanning portion 612 determines the rotational speed of the scanner motor 630 and causes the scanner motor controller 610 to control the scanner motor 630 so that the rotational speed of the scanner motor 630 is stabilized at the determined rotational speed.

Further, the scanning portion 612 calculates a laser light quantity on the basis of the rotational speed of the scanner motor 630 detected by the scanner motor speed detecting portion 614, or the like. Then, the scanning portion 612 causes the laser light quantity switching portion 611 to set the calculated laser light quantity for the laser drive system circuit 130, so that the laser is emitted from the laser diode 107.

Incidentally, in the embodiment 1, the laser diode 107 is not turned on during actuation (during a start of rising) of the scanner motor 630. That is, the scanner motor 630 is forcedly rotated over a predetermined time without using input from the BD detecting portion 613. After the scanner motor 630 is rotated over the predetermined time, the scanning portion 612 causes the laser diode 107 to continuously perform forced light emission so that the BD detecting portion 613 can stably detect the BD signal. During this forced light emission, the photosensitive drum surface is irradiated with the laser light in an entire region including an image forming region with respect to the main scan direction. Then, when the scanning portion 612 detects the BD signal by causing the laser diode 107 to continuously emit laser forcedly for the predetermined time, the scanning portion 612 starts control of the rotational speed of the scanner motor 630 by the BD signal from the BD sensor 121. Further, the scanner portion 612 starts the control of the rotational speed of the scanner motor 630 by the BD signal, and substantially at the same time, the scanning portion 612 causes a transition of light emission of the laser diode 107 to light emission only in a non-image forming region (hereinafter, this light emission is referred to as "unblanking light emission"). Thereafter, the scanning portion 612 maintains the unblanking light emission. Incidentally, when the image formation is started, in addition to the unblanking light emission, light emission of the laser diode 107 depending on the image signal is also performed in the image forming region.

Incidentally, in the following description, for simplification, the above-described operations (processes) by the respective functional blocks of the optical controller 406 is described as the operations (processes) of the optical controller 406 or the engine controller 403 providing the instruction to the optical controller 406.

7. Problem

Next, a phenomenon which is a problem will be specifically described. Parts (a) and (b) of FIG. 8 are timing charts each showing an example of the operations of the respective portions during a start of a print operation in a comparison example in which control of a start timing of an operation in which the developing roller 4 is contacted to the photosensitive drum 1 (herein, simply referred to as a "contact operation") in the embodiment 1 (described later) is performed. Part (a) of FIG. 8 shows the case where rising of the developing motor 101 is relatively slow (a time required that the rotational speed thereof reaches a predetermined rotational speed is relatively long). Part (b) of FIG. 8 shows the case where the rising of the developing motor 101 is relatively fast (the time required that the rotational speed thereof reaches the predetermined rotational speed is relatively short). There is a possibility that such a difference occurs due to an individual difference of the devices and parts thereof or a fluctuation in electric power supplied to the devices or the like. Each of T0*a* to T5*a* in part (a) of FIGS. 8 and T0*b* to T5*b* in part (b) of FIG. 8 represents a timing. Further, in this case, the case where a print instruction is inputted to the image forming apparatus 100 in a stand-by state and a state operation in the full-color mode is a rotation amounted amount will be described as an example.

Incidentally, the image forming apparatus 100 of this comparison example has the substantially same constitution as the constitution of the image forming apparatus 100 of the embodiment 1 except that that the control of the start timing of the contact operation of the developing roller 4 in the embodiment 1 (described later) is not carried out. Also, as regards the comparison example, elements having the same or corresponding functions or constitutions will be described by adding thereto the same reference numerals or symbols.

Further, in the embodiment 1 (ditto for the comparison example), as regards the image forming portions S for forming the toner images in the operations in the image forming modes, when the rotation of the developing motor 101 is started, rotations of the photosensitive drum 1 and the developing roller 4 are started, and substantially at the same time, applications of the charging voltage and the developing voltage are started. As regards the image forming portions S for the colors of yellow, magenta, and cyan in which the toner images are not formed in the operation in the monochromatic mode, these image forming portions S are provided with a clutch or the like for releasing the drive transmission from the developing motor 101 so as to stop the drive of the photosensitive drum 1 and the drive of the developing roller 4 during the operation in the monochromatic mode.

The case of part (a) of FIG. 8 will be described. With the start of the print operation, the engine controller 403 actuates the scanner motor 630 and the developing motor 101 and drives the solenoid 503, so that the contact operation of the developing roller 4 to the photosensitive drum 1 is started (T0*a*). Further, when the engine controller 403 forcedly accelerates the scanner motor 630 for the predetermined time, the engine controller 403 starts forced light emission of the laser diode 107 (T1*a*). By this forced light emission of the laser diode 107, the surface of the photosensitive drum 1 is exposed to light. In this case, a region on the photosensitive drum 1 exposed to light by this forced light emission (laser light irradiation position by the forced light emission) is referred to as a "forced light emission region". When the engine controller 403 performs the forced light emission over the predetermined time, the engine controller 403 causes the laser diode 107 to be turned on in the non-image forming region and causes the transition to the unblanking light emission in which the rotational speed of the scanner motor 630 is controlled on the basis of output of the BD sensor 121 (T2*a*). The rotational speed of the developing motor 101 reaches a predetermined rotational speed (T3*a*), and when the developing motor 101 is driven for the predetermined time, the contact and separation state of the developing roller 4 is switched from the all-separation state to the all-contact state (T5*a*). On the other hand, the entire surface of the photosensitive drum 1 is exposed to light from the start of the forced light emission of the laser diode 107 (T1*a*) until the forced light emission is completed (T2*a*). In the case of part (a) of FIG. 8, after a forced light emission region on the photosensitive drum 1 passes through the developing position (T4*a*), the contact and separation state of the developing roller 4 is switched from the all-separation state to the all-contact state (T5*a*).

The case of part (b) of FIG. 8 will be described. With the start of the print operation, the engine controller 403 actuates the scanner motor 630 and the developing motor 101 and drives the solenoid 503, so that the contact operation of the developing roller 4 to the photosensitive drum 1 is started (T0*b*). Further, when the engine controller 403 forcedly accelerates the scanner motor 630 for the predetermined time, the engine controller 403 starts forced light emission of the laser diode 107 (T1*b*). By this forced light emission of the laser diode 107, the surface of the photosensitive drum 1 is exposed to light. When the engine controller 403 performs the forced light emission over the predetermined time, the engine controller 403 causes the laser diode 107 to be turned on in the non-image forming region and causes the transition to the unblanking light emission in which the rotational speed of the scanner motor 630 is controlled on the basis of output of the BD sensor 121 (T2*b*). The rotational speed of the developing motor 101 reaches a predetermined rotational speed (T3*b*), and when the developing motor 101 is driven for the predetermined time, the contact and separation state of the developing roller 4 is switched from the all-separation state to the all-contact state (T4*b*). On the other hand, the entire surface of the photosensitive drum 1 is exposed to light from the start of the forced light emission of the laser diode 107 (T1*ab* until the forced light emission is completed (T2*b*). In the case of part (b) of FIG. 8, before a forced light emission region on the photosensitive drum 1 passes through the developing position (T5*b*), the contact and separation state of the developing roller 4 is switched from the all-separation state to the all-contact state (T4*b*). In this case, the toner is moved from the developing roller 4 onto the photosensitive drum 1 in the forced light emission region, so that the toner image is formed. For that reason, the toner is consumed uselessly. Further, for example, this toner is moved to the intermediary transfer belt 80 or the like, so that there is a possibility that contamination of the image and the recording material P with the toner occurs during subsequent image formation.

Thus, in the case where rising of the exposure unit 11 and rising of the developing motor 101 cooccur, depending on a time until the rotational speed of the developing motor 101 reaches the predetermined rotational speed, there is a possibility that the case where the toner is moved to the exposed region on the photosensitive drum 1 during the rising of the exposure unit 11 occurs. For that reason, it is desirable that the contact operation of the developing roller 4 is started in consideration of a time required for the rising of the developing motor 101 (a time until the rotational speed of the developing motor 101 reaches the predetermined rotational speed). On the other hand, when the contact operation of the developing roller 4 is started after a lapse of passing, through the developing position, of the forced light emission region on the photosensitive drum 1, the FPOT becomes long.

Here, depending on a time required for the rising of the developing motor 101 (a time until the contact operation of the developing roller 4 is completed), the following operation may only be required to be performed. That is, depending on this time, the contact operation start timing of the developing roller 4 is set so that a timing when the forced light emission region on the photosensitive drum 1 passes through the developing position and a timing when the contact operation of the developing roller 4 is completed are caused to coincide with each other. By this, it becomes possible to suppress movement of the toner to the region on the photosensitive drum 1 exposed to light during the rising of the exposure unit 11 while minimizing the FPOT. However, as described above, the time required for the rising of the developing motor 101 (the time until the contact operation of the developing roller 4 is completed) varies in some instances due to the individual difference of the devices and the parts thereof or the fluctuation in electric power supplied to the devices. Particularly, as in the embodiment 1, in the case where as the driving source for the contact and separation unit 500, a driving source common to the contact and separation unit 500 and other driven portions such as the developing roller 4 and the photosensitive drum 1 is used, the above-described variation is liable to occur in some cases due to the individual difference of the respective parts. For that reason, it is difficult in some instances that the above-described contact operation start timing of the developing roller 4 is set with accuracy in advance.

8. Operation During Initializing Operation

In the embodiment 1, the engine controller 403 executes a process in which during the initializing operation of the image forming apparatus 100, various times (timings) relating to the contact operation of the developing roller 4 (herein, this process is simply referred to as a "measuring process". In this embodiment, the contact and separation unit 500, the developing roller 4, and the photosensitive drum 1 are driven by the developing motor 101 which is a common driving source. Therefore, in this embodiment, in the measuring process during the initializing operation, a time until the contact operation of the developing roller 4 is completed and a time until the forced light emission region on the photosensitive drum 1 passes through the developing position are estimated (calculated). Then, on the basis of these times, the contact operation start timing of the developing roller 4 during subsequent print is determined.

Incidentally, the initializing operation (initializing process) is a preparatory operation for putting the image forming apparatus 100 is in an image formable state, and is executed in the case where the power source of the image forming apparatus 100 is turned on, the case where exchange of the process cartridge 9 is made, and in the like case. In the initializing operation, in addition to the above-described measuring process, a self-diagnostic process of the apparatus (device) such as a check as to whether or not the recording material P remains in a feeding passage of the recording material P or a check as to whether or not each of actuates normally operates is carried out.

FIG. 9 is a timing chart showing an example of the operation of the measuring process during the initializing operation in the embodiment 1. In FIG. 9, each of T0 to T4 represents a timing.

In the embodiment 1, in the measuring process during the initializing operation, the scanner motor 630 is not actuated. It is assumed that the scanner motor 630 is activated with progression of the rotational speed acquired in advance on the assumption that the scanner motor 630 is actuated (start of rising, start of electric power supply) substantially simultaneously with the actuation (start of rising, start of electric power supply) of the developing motor 101. By this, movement of the toner from the developing roller 4 to the photosensitive drum 1 in the measuring process is suppressed. Then, on the basis of the rotational speed of the developing motor 101, a time until the contact operation of the developing roller 4 is completed (herein, simply referred to as a "contact completion time") Tattach and a time until the forced light emission on the photosensitive drum 1 passes through the developing position (herein, simply referred to as a "light emission region passing time") Tf are estimated (calculated). Further, on the basis of the estimated contact completion time Tattach and the estimated light emission region passing time Tf, a start timing of the contact operation of the developing roller 4 during the printing (herein, simply referred to as a "contact operation start timing") Tsol is determined. This contact operation start timing is used, until is subsequently determined (updated), when the contact operation of the developing roller 4 during subsequent printing (and later) is started. Incidentally, in the embodiment 1, the contact operation start timing Tsol is determined in the measuring process during the initializing operation, but in the measuring process, the times Tattach and Tf may be determined, and the timing Tsol may be determined when the print operation is executed.

First, a method of determining the contact completion time Tattach depending on a time required for the rising (actuation) of the developing motor 101 will be described. The contact completion time Tattach is determined by a time required from during the actuation of the developing motor 101 (during the start of the rising) until the contact operation of the developing roller 4 is completed.

The engine controller 403 executes the initializing operation when the power source of the image forming apparatus 100 is turned on. During the start of the initializing operation, the contact and separation state of the developing roller 4 becomes the all-separation state. Then, when the initializing operation is started, the engine controller 403 causes the developing motor 101 to rise toward a target rotational speed (target number of revolutions) Vtarget (T0). The engine controller 403 causes the solenoid 503 to drive (start electric power supply over a predetermined time) for switching the contact and separation state of the developing roller 4 from the all-separation state to the all-contact state, substantially simultaneous with a start of the actuation (rising) of the developing motor 101. Further, the engine controller 403 starts to measure a time until the contact and separation state of the developing roller 4 is switched from the all-separation state to the all-contact state substantially simultaneous with the start of the actuation of the developing motor 101 (T0).

Then, the engine controller 403 awaits until the forced light emission is completed. Here, in the case where the developing motor 101 and the scanner motor 630 are actuated substantially simultaneously with each other, a time Te from the actuation of the developing motor 101 (the scanner motor 630) until the forced light emission is completed is simply referred to as a "forced light emission completion time"). When the forced light emission completion time Te has elapsed, the engine controller 403 stores the rotational speed of the developing motor 101 during the lapse of the time Te (T1). Further, the engine controller 403 stores a time Tr required from the actuation of the developing motor 101 until the rotational speed of the developing motor 101 reaches the target rotational speed Vtarget (T2).

The contact and separation state of the developing roller 4 makes a transition from the all-separation state to the all-contact state by way of an intermediate state between the all-separation state and the all-contact state. Under control of the engine controller 403, the developing contact controller 407 acquires a rotational speed V1*a* of the developing motor 101 when a predetermined time from a start timing t0 (corresponding to the above-described T0) to a timing t1 in the initializing operation has elapsed. In this case, the predetermined time (speed acquisition time) is t1. The time from the timing t0 to the timing t1 can also be said as a driving time from the start of the initializing operation (the time of actuation of the developing motor 101). The developing contact controller 407 calculates a rotation amount L1*a* of the developing motor 101 from the timing t0 to the timing t1 by the following formula (1).

$$L1a=\int_0^1 V(t)dt \quad (1)$$

Further, the developing contact controller 407 calculates and stores a cumulative addition value D1*a*=L1*a* which is an integrated value of the rotation amount of the developing motor 101 from the start of the initializing operation (the time of actuation of the developing motor 101).

Similarly, when the predetermined time from the timing t1 to the timing t2 has elapsed, the developing contact controller 407 acquires a rotational speed V2*a* of the developing motor 101. The time from the timing t1 to the timing t2 can also be said as a driving time of the developing motor 101. The developing contact controller 407 calculates a rotation amount L2*a* of the developing motor 101 from the timing t1 to the timing t2 by the following formula (2).

$$L2a=\int_1^2 V(t)dt \quad (2)$$

Further, the developing contact controller 407 calculates and stores a cumulative addition value Da2=D1*a*+L2*a* which is an integrated value of the rotation amount of the developing motor 101 from the start of the initializing operation (the time of actuation of the developing motor 101).

Thereafter, the developing contact controller 407 acquires a rotational speed Vna (n=1, 2, . . . x) every lapse of a predetermined time until the contact and separation state of the developing roller 4 is switched from the all-separation state to the all-contact state, and calculates an integrated value of the rotation amount. The developing contact controller 407 repeats the operation.

The developing contact controller 407 calculates a rotation amount Lna of the developing motor 101, by the following formula (3), every lapse of a time tna until the cumulative addition amount Dna of the rotation amount of the developing motor 101 and a rotation amount Dfull of the developing motor 101 which is acquired in advance and which is a rotation amount from the start of the contact operation of the developing roller 4 until the contact operation of the developing roller 4 is completed satisfy a relationship of: Dna≥Dfll (n=1, 2, . . . x).

$$Lna=\int_{n-1}^{n} V(t)dt \quad (3)$$

Further, the developing contact controller 407 calculates the cumulative addition value Dna of the rotation amount of the developing motor 101 from the time of the start of the initializing operation (at the time of actuation of the developing motor 101) by the following formula (4).

$$Dna=\int_0^n V(t)dt \quad (4)$$

In the case where Dna≥Dfull holds when a time txa has elapsed from the time (T0) of the start of the initializing operation, the developing contact controller 407 discriminates that the transition of the contact and separation state of the developing roller 4 from the all-separation state to the all-contact state is completed. That is, in the case where the cumulative addition value Dna becomes a predetermined value (Dfull) or more, the developing contact controller 407 discriminates that the transition of the contact and separation state of the developing roller 4 from the all-separation state to the all-contact state is completed. Then, the developing contact controller 407 stores, at a timing when the developing contact controller 407 discriminated the transition to the all-contact state, a time required from the start of the initializing operation (the actuation of the developing motor 101) until the developing contact controller 407 discriminates the transition to the all-contact state, i.e., the contact completion time Tattach (T3).

Next, a method of determining the light emission region passing time Tf depending on a time required for actuation of the developing motor 101 will be described. The light emission region passing time Tf is determined by a time from a time required from completion of the forced light emission until the developing motor 101 is rotated by a rotation amount Ddev corresponding to a distance from the exposure position to the developing position with respect to the rotational direction of the photosensitive drum 1.

Under control of the engine controller 403, when a predetermined time has elapsed from the timing (T1) when the forced light emission is completed, the developing contact controller 407 acquires a rotational speed V1*b* of the developing motor 101. In this embodiment, this predetermined time (speed acquisition interval) is t1. In the embodiment 1, the photosensitive drum 1 is driven by the developing motor 101 which is the driving source common to the photosensitive drum 1, the developing roller 4, and the contact and separation unit 500. Accordingly, this time not only can be said as being a driving time of the developing motor 101 from the completion of the forced light emission but also correlates with a rotation amount of the photosensitive drum 1 (movement distance of the position on the photosensitive drum 1). The developing contact controller 407 calculates, by the following formula (5), a rotation amount (correlating with the movement distance of the forced light emission region (forced light emission completion position) on the photosensitive drum 1) L1*b* of the developing motor 101 from the completion of the forced light emission.

$$L1b=\int_0^1 V(t)dt \quad (5)$$

Further, the developing contact controller 407 calculates and stores a cumulative addition value D1*b*=L1*b* which is an integrated value of the rotation amount of the developing motor 101 from the completion of the forced light emission.

Similarly, when a subsequent predetermined time t1 has elapsed, the developing contact controller 407 acquires a rotational speed V2*b* of the developing motor 101. This time not only can be said as being a driving time of the developing motor 101 but also correlates with the rotation amount of the photosensitive drum 1 (movement distance of the position on the photosensitive drum 1). The developing contact controller 407 calculates a rotation amount L2*b* of the developing motor 101 in a period of this time by the following formula (6).

$$L2b=\int_1^2 V(t)dt \quad (6)$$

Further, the developing contact controller 407 calculates and stores a cumulative addition value D2*b*=D1*b*+L2*b* which is an integrated value of the rotation amount of the developing motor 101 from the completion of the forced light emission.

Thereafter, the developing contact controller 407 acquires a rotational speed Vmb (m=1, 2, . . . x) every lapse of a predetermined time until the forced light emission region (forced light emission completion position) on the photosensitive drum 1 passes through the developing position, and calculates an integrated value of the rotation amount of the developing motor 101. The developing contact controller 407 repeats this operation. The developing contact controller 407 calculates, by the following formula (7), a rotation amount Lmb of the developing motor 101 every lapse of a time tmb until a cumulative addition value Dmb of the rotation amount of the developing mechanism 101 and a rotation amount Ddev of the developing motor 101, corresponding to a distance from the exposure position to the developing position with respect to the rotational direction of the photosensitive drum 1, acquired in advance satisfy a relationship of: Dmb≥Ddev (m=1, 2, . . . x).

$$Lmb=\int_{m-1}^{m} V(t)dt \quad (7)$$

Further, the developing contact controller 407 calculates the cumulative addition value Dmb of the rotation amount of the developing motor 101 from the completion of the forced light emission by the following formula (8).

$$Dmb=\int_0^m V(t)dt \quad (8)$$

In the case where Dmb≥Ddev holds when a time txb has elapsed from the completion of the forced light emission, the developing contact controller 407 discriminates that the forced light emission region (forced light emission completion position) on the photosensitive drum 1 passes through the developing position. That is, in the case where the cumulative addition value Dmb becomes the predetermined value (Ddev) or more, the developing contact controller 407 discriminates that the forced light emission region (forced light emission completion position) on the photosensitive drum 1 has elapsed the developing position. Then, the developing contact controller 407 stores a time from the completion of the forced light emission until the developing contact controller 407 discriminates that the forced light emission region (forced light emission completion position) on the photosensitive drum 1 passes through the developing position, i.e., the forced light emission passing time Tf (T4).

Then, the developing contact controller 407 determines and stores the contact operation start timing Tsol on the basis of the above-determined contact completion time Tattach and the light emission region passing time Tf. Incidentally, for convenience, details of a method of determining the contact operation start timing Tsol will be described in explanation of an operation during the printing (described later).

Incidentally, in the embodiment 1, in the measuring process, the various times such as Tattach and Tf were measured on the assumption that the actuation of the developing motor 101 is started substantially simultaneously with the actuation of the scanner motor 620, but the present invention is not limited thereto. The various times such as Tattach and Tf can also be measured on the assumption that the developing motor 101 is actuated after an arbitrary predetermined time has elapsed from the time of actuation of the scanner motor 630.

9. Operation During Printing

FIGS. 10 and 11 are timing charts each showing an example of operations of respective portions at the time of a start of the printing operation in the case where control of a start timing of the contact operation of the developing roller 4 in the embodiment 1 is carried out. FIG. 10 shows the case where at the time of the start of the printing operation, the actuation of the developing motor 101 and the drive of the solenoid 503 are carried out substantially at the same time after the scanner motor 630 is actuated. Further, FIG. 11 shows the case where at the time of the start of the printing operation, the solenoid 503 is driven after the developing motor 101 and the scanner motor 630 are actuated substantially at the same time. Each of T0*a* to Ta2 in FIG. 10 and T0*b* to T3*b* in FIG. 11 represents a timing. Further, in this embodiment, the case where the printing operation in the full-color mode is started after the print instruction is inputted to the image forming apparatus 100 in the stand-by state.

The case of FIG. 10 will be described. When the engine controller 403 receives the print instruction from the printer controller 401, the engine controller 403 starts the printing operation and actuates the scanner motor 630 (starts the rising) (T01*a*). In this case, under control of the engine controller 403, the developing contact controller 407 (specifically, the contact operation start discriminating portion 918) calculates, by the following formula (9), a contact operation start timing Tsola as a timing when the actuation of the developing motor 101 and the drive of the solenoid 503 are carried out substantially at the same time, and stores the contact operation start timing Tsola.

$$Tsola=Te+Tf-Tattach \quad (9)$$

In the formula (9), Te represents a time from the actuation of the scanner motor 630 until the forced light emission is completed. Further, Tf represents from the completion of the forced light emission until the forced light emission region (forced light emission completion position) on the photosensitive drum 1 passes through the developing position. Further, Tattach (Tattach A in FIG. 10 represents a time until the transition of the contact and separation state of the developing roller 4 from the all-separation state to the all-contact state is completed in the case where the actuation of the developing roller 4 and the drive of the solenoid 503 are carried out substantially at the same time. The contact operation start timing Tsola can also be said as being a time from the start of the printing operation until the contact operation of the developing roller 4 is started (until the actuation of the developing motor 101 and the drive of the solenoid 503 are carried out substantially at the same time). Incidentally, as described above, in the embodiment 1, this contact operation start timing Tsola is calculated in the measuring process during the initializing operation, but may also be calculated when the printing operation is executed.

Then, the developing contact controller 407 carries out the actuation of the developing motor 101 and the drive of the solenoid 503 substantially at the same time when the time Tsola has elapsed from the time (T0*a*) of the start of the printing operation (substantially at the same time of a lapse of the time Tsola) (T1*a*).

By this, the contact operation of the developing roller 4 is completed at a timing when the forced light emission region on the photosensitive drum 1 passes through the developing position (substantially at the same timing as the passing timing) (T2*a*).

The case of FIG. 11 will be described. When the engine controller 403 receives the print instruction from the printer controller 401, the engine controller 403 starts the printing operation and actuates the developing motor 101 and the scanner motor 630 substantially at the same time (starts the rising) (T01*b*). In this case, under control of the engine controller 403, the developing contact controller 407 (specifically, the contact operation start discriminating portion 918) calculates, by the following formula (10), a contact operation start timing Tsolb as a timing when the drive of the solenoid 503 is carried out, and stores the contact operation start timing Tsola.

$$Tsolb=(Dxa-Dxb)/Ve \tag{10}$$

In the formula (10), Dxa represents a cumulative addition value of the rotation amount of the developing motor 101 from the actuation of the developing motor 101 and the scanner motor 630 substantially at the same voltage until the forced light emission region (forced light emission completion position) on the photosensitive drum 1 passes through the developing position. Further, Dxb represents a cumulative addition value of a rotation amount of the developing motor 101 (correlating with a movement distance of a position on the photosensitive drum 1) from the completion of the forced light emission until the forced light emission region (forced light emission completion position) on the photosensitive drum 1 passes through the developing position. Incidentally, Dxa and Dxb can be calculated and stored similarly as in the case of the above-described Dmb. Further, Ve represents a rotational speed of the developing motor 101 at a point of the time when the forced light emission is completed. The contact operation start timing Tsolb can also be said as being a time from the start of the printing operation until the contact operation of the developing roller 4 is started (until the drive of the solenoid 503 is carried out. The contact operation completion time Tattach (Tattach B in FIG. 11) is also acquired on the basis of a relationship represented by the above-described formula 19). Incidentally, as described above, in the embodiment 1, this contact operation start timing Tsola is calculated in the measuring process during the initializing operation, but may also be calculated when the printing operation is executed.

Then, the developing contact controller 407 carries out the drive of the solenoid 503 when the time Tsolb has elapsed from the time (T0*b*) of the start of the printing operation (substantially at the same time of a lapse of the time Tsolb) (T11)). Incidentally, T2*b* in FIG. 11 is a timing when the forced light emission is completed.

By this, the contact operation of the developing roller 4 is completed at a timing when the forced light emission region on the photosensitive drum 1 passes through the developing position (substantially at the same timing as the passing timing) (T2*b*).

By such control, in the case where a time until the contact operation is completed in the measuring process (test operation) is relatively long, a time to a timing when the contact operation in the preparatory operation during the printing is started can be made relatively short. Further, in the case where the time until the contact operation is completed in the measuring process (test operation) is relatively short, the time to the timing when the contact operation in the preparatory operation during the printing is started can be made long.

10. Procedure of Measuring Process During Initializing Operation

FIG. 12 is a flowchart showing an example of a procedure of the measuring process during the initializing operation of the image forming apparatus in the embodiment 1. Further, FIG. 13 is a flowchart showing an example of a part of the procedure in FIG. 12.

The engine controller 403 executes the initializing operation in the case where the power source of the image forming apparatus 100 is turned on or in the case where exchange of the process cartridge 9 is performed. Then, under control of the engine controller 403, the developing contact controller 407 clears the preliminarily stored cumulative addition value Dna of the rotation amount of the developing motor 101 from the actuation of the developing motor 101 (i.e., resets the Dna to an initial value (0 in the embodiment 1)). The developing contact controller 407 starts measurement of the rotation amount of the developing motor 101 (S101). Then, the developing contact controller 407 turns on the developing motor 101 and the solenoid 503 in order to make the transition of the contact and separation state of the developing roller 4 from the all-separation state to the all-contact state (S102). Further, under control of the engine controller 403, the optical controller 406 starts measurement of a time to forced light emission completion without actuating the scanner motor 630 in order to transmit a forced light emission completion timing to the engine controller 403 (S103). Incidentally, an update method of the rotation amount of the developing motor 101 in a subsequent step S104 will be described using FIG. 13.

Referring to FIG. 13, the developing contact controller 407 discriminates whether or not a predetermined sampling time (speed acquisition time) T has elapsed from last acquisition of the rotational speed of the developing motor 101 (S201). In the case where the sampling time T has elapsed, the developing contact controller 407 acquires a rotational speed Vmotor of the developing motor 101 (S202). Then, the developing contact controller 407 calculates a rotation amount Lna of the developing motor 101 from the actuation of the developing motor 101 on the basis of the sampling time T and the rotational speed Vmotor by the following formula (11) (S203). Further, the developing contact controller 407 calculates a rotation amount Lmb of the developing motor 101 from the completion of the forced light emission on the basis of the sampling toner T and the rotational speed Vmotor by the following formula (12) (S203).

$$Lna=\int_{n-1}^{n} V\mathrm{motor}(t)dt \tag{11}$$

$$Lmb=\int_{m-1}^{m} V\mathrm{motor}(t)dt \tag{12}$$

When the developing contact controller 407 calculates the rotation amount Lna, the developing contact controller 407 then calculates the cumulative addition value Dna of the rotation amount of the developing motor 101 from the actuation of the developing motor by the following formula (13) (S204). Further, when the developing contact controller 407 calculates the rotation amount Lmb, the developing contact controller 407 then calculates the cumulative addition value Dmb of the rotation amount of the developing motor 101 from the completion of the forced light emission by the following formula (14) (S204).

$$Dna=\int_0^n V\text{motor}(t)dt \quad (13)$$

$$Dmb=\int_0^m V\text{motor}(t)dt \quad (14)$$

Thus, the developing contact controller 407 updates the rotation amount of the developing motor 101 in S104 of FIG. 12.

The engine controller 403 discriminates whether or not the measurement of the rotation amount (correlation with the movement amount of the forced light emission region (forced light emission completion position) on the photosensitive drum 1) of the developing motor 101 from the completion of the forced light emission is started (S105). In the case where the measurement is not started (No of S105), the engine controller 403 discriminates whether or not the forced light emission is completed (whether or not information on a lapse of the time from the initializing operation until the forced light emission is completed is acquired from the optical controller 406) (S106). In the case where the measurement is completed (Yes of S106), the engine controller 403 stores the completion of the forced light emission and then clears the cumulative addition value Dmb of the rotation amount of the developing motor 101 from the completion of the forced light emission which has already been stored (i.e., resets the initial value (0 in the embodiment 1). Then, the engine controller 403 starts the measurement of the rotation amount of the developing motor 101 (S107).

In the case of Yes of S105, No of S106 or execution of S107, the engine controller 403 discriminates whether or not the time required until the forced light emission region reaches the developing position is stored (S108). In the case where the time is not stored (No of S108), the developing contact controller 407 discriminates whether or not the cumulative addition value Dmb of the rotation amount of the developing motor 101 from the completion of the forced light emission reaches a rotation amount Ddev of the developing motor 101 corresponding to a distance from the exposure position to the developing position with respect to the rotational direction of the photosensitive drum 1 (S109). That is, the developing contact controller 407 discriminates whether or not Dmb≥Dder is satisfied, and this relationship is satisfied, the developing contact controller 407 discriminates that the forced light emission region (forced light emission completion position) passes through the developing position. In the case where the developing contact controller 407 discriminated that the forced light emission region (forced light emission completion position) passes through the developing position (Yes of S109), the developing contact controller 407 stores the time Tf required from the completion of the forced light emission until the forced light emission region (forced light emission completion position) passes through the developing position (S110).

After Yes of S108, No of S109 or S110, the engine controller 403 discriminates whether or not the time Tr from the actuation of the developing motor 101 until the rotational speed reaches the target rotational speed Vtarget is stored (S111). In the case where the time Tr is not stored (No of S111), the developing contact controller 407 discriminates whether or not the rotational speed of the developing motor 101 acquired by the driving speed detecting portion 912 reaches the target rotational speed Vtarget (S112). In the case where the rotational speed reaches the target rotational speed Vtarget (Yes of S112), the developing contact controller 407 stores the time Tr required from the actuation of the developing motor 101 until the rotational speed reaches the target rotational speed Vtarget (S113).

In the case of Yes of S111, No of S112 or execution of S113, the engine controller 403 discriminates whether or not the time Tattach from the start of the contact operation of the developing roller 4 until the transition of the contact and separation state from the all-separation state to the all-contact state is completed is stored (S114). In the case where the time Tattach is not stored (No of S114), the developing contact controller 407 discriminates whether or not the cumulative addition value Dna of the developing motor 101 from the actuation of the developing motor 101 reaches the rotation amount Dfull of the developing motor 101 necessary for causing the transition of the contact and separation state of the developing motor 101 from the all-separation state to the all-contact state (S115). That is, the developing contact controller 407 discriminates whether or not Dna≥Dfull is satisfied, and if this relationship is satisfied, the developing contact controller 407 discriminates that the transition of the contact and separation state of the developing roller 4 from the all-separation state to the all-contact state is completed. In the case where the developing contact controller 407 discriminated that the transition of the contact and separation state of the developing roller 4 from the all separation state to the all contact state is completed (Yes of S115), the developing contact controller 407 stores the time Tattach required from the start of the contact operation of the developing roller 4 until the transition of the contact and separation state of the developing roller 4 from the all separation state to the all contact state is completed (S116).

The engine controller 403 discriminates whether or not all the measurements of the time Tf, the time Tr, and the time Tattach are completed (S117). In the case where all the measurements are not completed (No of S117), the engine controller 403 repetitively executes the processes of S104 to S116. In the case where all the measurements are completed (Yes of S117), the engine controller 403 determines the contact operation start timing Tsol during the printing (S118). The determining method of the contact operation start timing Tsol during the printing is as described above using FIGS. 10 and 11.

11. Control Procedure of Contact Operation Start Timing During Printing

FIG. 14 is a flowchart showing an example of a control procedure of the contact operation start timing of the developing roller 4 at the time of the start of the printing operation in the case described using FIG. 10. Further, FIG. 15 is a flowchart showing an example of a control procedure of the contact operation start timing of the developing roller 4 at the time of the start of the printing operation in the case described using FIG. 11. In this embodiment, the case where the printing operation in the full-color mode is started by inputting a print instruction to the image forming apparatus 100 in the stand-by state will be described as an example.

The case of FIG. 14 will be described. When the engine controller 403 receives the print instruction from the printer controller 401, the engine controller 403 starts the printing operation. The engine controller 403 causes the optical controller 406 to actuate the scanner motor 630 (S301). The engine controller 403 awaits until the time Tsola has elapsed from the actuation of the scanner motor 630 (S302). When the time Tsola has elapsed, the engine controller 403 causes the developing contact controller 407 to actuate the developing motor 101 and to turn on the solenoid 503 substantially simultaneously therewith in order to make the transition of the contact and separation state of the developing roller 4 from the all-separation state to the all-contact state (S303). The engine controller 403 awaits until the time Tattach has elapsed from the start of the contact operation of the developing roller 4 (S304). When the time Tattach has elapsed, the engine controller 403 starts the image formation (S305).

The case of FIG. 15 will be described. When the engine controller 403 receives the print instruction from the printer controller 401, the engine controller 403 starts the printing operation. The engine controller 403 causes the optical controller 406 to actuate the scanner motor 630 and causes the developing contact controller 407 to actuate the developing roller 4 substantially the same time (S401). The engine controller 403 awaits until the time Tsolb has elapsed from the actuation of the scanner motor 630 and the developing motor 101 (S402). When the time Tsolb has elapsed, the engine controller 403 causes the developing contact controller 407 to turn on the solenoid 503 in order to make the transition of the contact and separation state of the developing roller 4 from the all-separation state to the all-contact state (S403). The engine controller 403 awaits until the time Tattach has elapsed from the start of the contact operation of the developing roller 4 (S404). When the time Tattach has elapsed, the engine controller 403 starts the image formation (S405).

Incidentally, in the embodiment 1, the case where the photosensitive drum 1 is driven by the developing motor 101 which is the driving source common to the photosensitive drum 1, the contact and separation unit 500, and the developing roller 4 was described, but the photosensitive drum 1 may be driven by a motor separatory from a motor for the contact and separation unit 500 and the developing roller 4. In that case, for example, the light emission region passing time Tf can be acquired by detecting (estimating) the rotation amount through detection (estimation) of the rotational speed similarly as in the above-described case of the developing motor 101, and a predetermined value acquired in advance can be used as the light emission region passing time Tf.

Incidentally, in the embodiment 1, description was made on the assumption that in the measuring process, the time Tr required from the actuation of the developing motor 101 until the rotational speed reaches the target rotational Vtarget (i.e., a time required for the rising of the developing motor 101: rising completion time) is measured. In the case where the rising completion time Tr is not used in setting of the contact operation start timing, the process of measuring the rising completion time Tr may be omitted. However, when the rising completion time Tr is measured and stored, it is possible to grasp which degree of a load imposed at present. This rising completion time Tr can also be said as being information on a switching time which is a time required to switch the contact and separation state of the developing member from the separated state to the contact state. Then, on the basis of this rising completion time Tr, the contact operation start timing can be set (predicted). For example, a relationship between the rising completion time Tr and the contact completion time Tattach (further, the light emission region passing time Tf) is acquired in advance. Then, on the basis of the rising completion time Tr measured and stored in the measuring process, the contact operation start timing Tsol can be determined from the relationship. Further, for example, a relationship between the rising completion time Tr and the contact operation start timing Tsol based on the contact completion time Tattach (further, the light emission region passing time Tf) depending on the time Tr is acquired in advance. Then, on the basis of the rising completion time Tr measured and stored in the measuring process, the contact operation start timing Tsol can be determined from the relationship. Typically, in the case where the rising completion time Tr is relatively long, a time to a timing when the contact operation in the preparatory operation during the printing is started can be made relatively short. Further, in the case where the rising completion time Tr is relatively short, the time to the timing when the contact operation in the preparatory operation during the printing can be made relatively long.

Thus, the image forming apparatus 100 of the embodiment 1 includes the a photosensitive member 1 rotatable in a predetermined rotational direction, the charging member 2 which is a charging device for electrically charging the surface of the photosensitive member 1 at the charging position with respect to the rotational direction, the exposure unit 11 for exposing, to light, the surface of the photosensitive member 1 at the exposure position downstream of the charging position with respect to the rotational direction, the developing unit including the developing member 4 rotatable and contactable to the surface of the photosensitive member 1 at the developing position downstream of the exposure position and upstream of the charging position with respect to the rotational direction and for supplying a developer to the photosensitive member 1 by the developing member 4, the motor 101 for driving the developing member 4, the contact and separation unit 500 to which the driving force from the motor 101 is transmitted and for switching the state of the developing member 4 between the contact state in which the developing member 4 is contacted to the photosensitive member 1 and the separated state in which the developing member 4 is separated from the photosensitive member 1, and executes, before image formation, the light emitting operation for forming a potential at which the developer is capable of being deposited on the photosensitive member 1 by exposing, to light, the region including the image forming region with respect to the rotational axis direction of the photosensitive member 1 in a light emission period by the exposure unit 11, and the preparatory operation including actuation of the motor 101 and the contact operation for switching the state of the developing member 4 from the separated state to the contact state in the switching period by the contact and separation unit 500. Further, the image forming apparatus 100 of the embodiment 1 includes the acquiring portion (developing contact controller) 407 for acquiring information on the switching time which is the time required for switching the state of the developing member 4 from the separated state to the contact state by executing the contact operation by the contact and separation unit 500, and the setting portion (engine controller) 403 for setting, on the basis of the information on the switching time acquired by the acquiring portion 407, the start timing which is the timing when the contact operation by the contact and separation unit 500 is started in the preparation operation and which is the timing before the region on the photosensitive member 1 exposed to light in the light emission period reaches the developing position. In the embodiment 1, the setting portion 403 sets the start timing so that: in a case that a time indicated by the information on the switching time is a first time, a time from a start of the preparatory operation to the start region is a second time, and in a case that the time indicated by the information on the switching time is a third time shorter than the first time, the time from the start of the preparatory operation to the start timing is a fourth time longer than the second time. Incidentally, the time of the start of the preparatory operation can be made specifically a time of input of the print instruction to the engine controller 403. In the embodiment 1, the exposure unit 11 includes the light emitting portion (laser diode) 107 for emitting the light and the polygon mirror 133, the light emitted from the light emitting portion 107 is reflected by the rotating polygon mirror 133 and the photosensitive drum 1 is irradiated with the light. The above-described period is included in a period in which rotation of the polygon mirror 133 is not in the steady state.

Further, in the embodiment 1, the acquiring portion 407 includes the speed acquiring portion (driving speed detecting portion) 912 for acquiring information on the rotational speed of the motor 101, and the rotation amount acquiring portion (rotation amount estimating portion) 913 for acquiring information on the rotation amount of the motor 101 on the basis of information on the plurality of rotational speeds acquired by the speed acquiring portion 912 with a lapse of a time, and the acquiring portion acquires the information on the switching time on the basis of a time required for rotating the motor 101 by a predetermined rotation amount. In the embodiment 1, the predetermined rotation amount is a rotation amount of the motor 101 required for switching the state of the developing member 4 from the separated state to the contact state by the contact and separation unit 500. Further, in the embodiment 1, the setting portion 403 sets the above-described start timing so that the developing member 4 is in the contact state on or after the time when the region on the photosensitive drum 1 exposed to light in the above-described light emission period finishes the passing through the developing position. Typically, the setting portion sets the above-described start timing so that the developing member 4 is in the contact state substantially at the same time as the time when the region on the photosensitive member exposed to light in the light emission period finishes the passing through the developing position. However, the timing when the developing member 4 is in the contact state may be deviated from the time when the region on the photosensitive drum 1 exposed to light in the above-described light emission period finishes the passing through the developing position in a range allowed from the viewpoint of shortening of the FPOT, or the like, for example. Further, in the embodiment 1, the controller carries out control so as to execute, before the preparatory operation is executed, a test operation (measuring process) in which the information on the switching time is acquired by performing the contact operation by the contact and separation unit 500. The setting portion 403 sets the above-described start timing in the preparatory operation executed after the test operation is executed, on the basis of the information on the switching time acquired in the test operation. In the embodiment 1, the test operation is executed in the case where the power source of the image forming apparatus 100 is turned on or in the case where the exchange unit (process cartridge 9 or the like) of the image forming apparatus 100 is exchanged.

Particularly, in the embodiment 1, the photosensitive drum 1 is driven by the motor 101 which is the driving source common to the photosensitive drum 1, the developing member 4, and the contact and separation unit 500. Further, in the embodiment 1, the acquiring portion 407 acquires the information on the switching time on the basis of a time required for rotating the motor 101 by a predetermined first rotation amount, and acquires information on a passing time which is a time required that the region on the photosensitive member 1 exposed to light in the above-described light emission period finishes the passing through the developing position, on the basis of a time required for rotating the motor by a predetermined second rotation amount, and the setting portion 403 sets the start timing so that the developing member 4 is in the contact state on or after the time when the region on the photosensitive member 1 exposed to light in the above-described light emission period passes through the developing position. The predetermined first rotation amount is a rotation amount of the motor required for switching the state of the developing member 4 from the separated state to the contact state by the contact and separation unit 500, and the predetermined second rotation amount is a rotation amount of the motor 101 required that the region on the photosensitive member 1 exposed to light in the above-described light emission period is moved from the exposure position to the developing position. In this case, before the preparatory operation is executed, the acquiring portion 407 executes the test operation for acquiring the information on the switching time and the information on the passing time by performing the contact operation by the contact and separation unit 500.

As described above, in the embodiment 1, the contact operation start timing of the developing roller 4 is controlled (adjusted) depending on the time required for the rising of the developing motor 101. By this, depending on the time required for the rising of the developing motor 101, the developing roller 4 can be contacted to the photosensitive drum 1 after the region on the photosensitive drum 1 exposed to light at the time of the rising of the exposure unit 11. Accordingly, shortening of the FPOT can be realized by performing the actuation of the developing motor 101 at an earliest timing while suppressing the movement of the toner to the region on the photosensitive drum 1 exposed to the light at the time of the rising of the exposure unit 11.

Next, another embodiment of the present invention will be described. Basic constitution and operation of an image forming apparatus of an embodiment 2 are the same as those of the image forming apparatus of the embodiment 1. Accordingly, in the image forming apparatus of the embodiment 2, as regards elements having the same or corresponding functions and constitutions as those in the image forming apparatus of the embodiment 1, reference numerals or symbols which are the same as those in the embodiment 1 are added and detailed description thereof will be omitted.

In the embodiment 2, depending on input of a commercial power source used by the image forming apparatus 100, fluctuation in time required for the rising of the developing motor 101 is predicted, and the contact operation start timing of the developing roller 4 is changed.

FIG. 16 is a function block diagram for illustrating a system constitution of the image forming apparatus 100 of the embodiment 2. The system constitution of the image forming apparatus 100 of this embodiment is roughly similar to the system constitution of the image forming apparatus 100 of the embodiment 1 described using FIG. 2. However, in the embodiment 2, the printer engine 402 is provided with a power source controller 409. On the basis of an instruction from the engine controller 403, the power source controller 409 controls supply of electric power necessary to be outputted from the respective controllers (the recording material feeding portion 404, the fixing controller 405, the optical controller 406, the developing contact controller 407, and the image controller 408).

The power source controller 409 includes, function blocks, an input voltage detecting portion 950, a detected power storing portion 951, and an operation power fluctuation discriminating portion 952. The input voltage detecting portion 950 detects an input voltage inputted from the commercial power source. The detected power storing portion 951 stores the voltage of the power source inputted from an external portion every start of the printing operation by the image forming apparatus 100 on the basis of the input of the input voltage detecting portion 950. The operation power fluctuation discriminating portion 952 discriminates whether or not the input voltage of the image forming apparatus 100 fluctuates, on the basis of a difference between an input voltage detected by the input voltage detecting portion 950 at the time of the start of the printing operation and the input voltage during the last printing stored in the detected power storing portion 951. Incidentally, the input voltage compared with the input voltage during the present printing is not limited to the input voltage during the last printing, and if the fluctuation in input voltage can be detected with sufficient accuracy, an input voltage during arbitrary printing before the present printing can be used. For example, it is possible to compare the input voltage during the arbitrary printing until before a predetermined time with the input voltage during the present printing.

FIG. 17 is a timing chart showing an example of operations of the respective portions in the case where in control of the contact operation start timing of the developing roller 4 in the embodiment 2, discrimination that the input voltage is fluctuated at the time of the start of the printing operation. In FIG. 17, each of T0 to T3 represents a timing. Further, in this embodiment, the case where the printing operation in the full-color mode is started by inputting the print instruction to the image forming apparatus 100 in the stand-by state is described as an example.

In the embodiment 2, the engine controller 403 acquires the input voltage of the power source inputted from the external portion to the image forming apparatus 100, on the basis of the input of the input voltage detecting portion 950 of the power source controller 409. Then, the engine controller 403 causes the operation current fluctuation discriminating portion 952 of the power source controller 409 to compare the input voltage at the time of the start of the last printing operation stored in the detected power storing portion 951 of the power source controller 409 with the input voltage acquired in the present printing operation. In the case where a difference (in absolute value) between the last input voltage and the present input voltage is less than a predetermined fluctuation amount determined in advance, the engine controller 403 starts the contact operation of the developing roller 4 by using the contact operation start timing Tsol determined as described above in the embodiment 1 (FIGS. 10 and 11). On the other hand, in the case where the difference between the last input voltage and the present input voltage is not less than the predetermined fluctuation amount, an operation as shown in FIG. 17 is performed without using the contact operation start timing Tsol detected as described above in the embodiment 1.

That is, the engine controller 403 starts the printing operation (specifically, the preparatory operation before the image formation) when receives the print instruction from the printer controller 401, and then causes the optical controller 406 to actuate the scanner motor 630 and causes the developing contact controller 407 to actuate the developing motor 101 substantially at the same time (T0). Thereafter, the engine controller 403 discriminates whether or not the forced light emission is completed when the rotational speed of the developing motor 101 reaches the target rotational speed Vtarget. When the forced light emission is completed, the engine controller 403 drives the developing motor 101 by a rotation amount corresponding to a distance from the exposure position to the developing position with respect to the rotational direction of the photosensitive drum 1. When the developing motor 101 is driven by the rotation amount, substantially at the same time, the engine controller 403 drives the solenoid 503 for starting the contact operation of the developing roller 4 (T2). Thereafter, when the developing motor 101 is driven by a rotation amount corresponding to switching of the contact and separation state of the developing roller 4 from the all-separation state to the all-contact state, the engine controller 403 starts the image formation (T3).

FIG. 18 is a flowchart showing an example of a control procedure of the contact operation start timing of the developing roller 4 at the time of the start of the printing operation in the embodiment 2. In this embodiment, the case where the printing operation in the full-color mode is started by inputting the print instruction to the image forming apparatus 100 in the stand-by state is described as an example.

The engine controller 403 starts the printing operation when receives the print instruction from the printer controller 401. The engine controller 403 acquires the input voltage from the external power source by the power source controller 409 (S501). The engine controller 403 compares the input voltage at the time of the start of the present printing operation acquired in S501 with the input voltage at the time of the start of the last printing operation stored. Then, the engine controller 403 discriminates whether or not the difference between the last input voltage and the present input voltage fluctuates in an amount which is not less than a predetermined fluctuation amount (S502). Here, the case where the input voltage fluctuates refers to the case where the input voltage fluctuates in an amount which is not less than the predetermined fluctuation amount determined in advance on the basis of an experiment or the like. In the embodiment 2, for example, in the case where the difference between the last input voltage and the present input voltage is 10 V or more, the engine controller 403 discriminates that the input voltage fluctuated.

In the case where the engine controller 403 discriminated that the input voltage fluctuated (Yes of S502), the engine controller 403 actuates the scanner motor 630 and the developing motor 101 substantially at the same time (S503), and then until the rotational speed of the developing motor 101 reaches the target rotational speed Vtarget (S504). When the rotational speed of the developing motor 101 reaches the target rotational speed Vtarget, the engine controller 403 awaits until the forced light emission of the exposure unit 11 is completed (S505). When the forced light emission is completed, the engine controller 403 executes update of the rotation amount of the developing motor 101 (S506). An updating method of the rotation amount of the developing motor 101 is the same as the updating method described in the embodiment 1 by using FIG. 13.

From the completion of the forced light emission, the engine controller 403 awaits until the developing motor 101 is driven by a rotation amount corresponding to a distance from the exposure position to the developing position with respect to the rotational direction of the photosensitive drum 1 (S507). Here, in the embodiment 2, also at the time of the start of the printing operation, by measuring the time required for the rising of the developing motor 101, the time required for the rising of the developing motor 101 in which there is a possibility that the time fluctuates due to the fluctuation of the input voltage is stored. Then, the contact operation start timing Tsol is updated for subsequent printing.

When the developing motor 101 is driven by the rotation amount corresponding to the above-described distance from the exposure position to the developing position, the engine controller 403 actuates the solenoid 503 for starting the contact operation of the developing roller (S508). The engine controller 403 awaits a lapse of the time Tattach necessary to complete the contact operation of the developing roller 4 (S509). When the time Tattach has elapsed, the engine controller 403 starts the image formation (S510).

On the other hand, in the case where the engine controller 403 discriminated that the input voltage does not fluctuate (No of S502), the engine controller 403 actuates the scanner motor 630 and the developing motor 101 substantially at the same time (S511), and then awaits until the time Tsol determined similarly as in the embodiment 1 has elapsed (S512). When the time Tsol has elapsed, the engine controller 403 drives the solenoid 503 for starting the contact operation of the developing roller 4 (S513). The engine controller 403 awaits until the time Tattach necessary to complete the contact operation of the developing roller 4 (S513). When the time Tattach has elapsed, the engine controller 403 starts the image formation (S514). Incidentally, in this embodiment, in the case where the input voltage does not fluctuate, the contact operation start timing is controlled similarly as in the procedure of FIG. 15 described in the embodiment 1, but the contact operation start timing may also be controlled similarly as in the procedure of FIG. 14 described in the embodiment 1.

Incidentally, the rising completion time Tr measured and stored in the measuring process can be reflected in, for example, discrimination as to whether or not the contact operation start timing determined by the measuring process is used.

For example, on the basis of the rising completion time Tr, the predetermined fluctuation amount (threshold) compared with the above-described difference (in absolute value) between the input voltages can be changed. Typically, in the case where the rising completion time Tr is relatively short (the case where the load is relatively small), the threshold can be made relatively large (i.e., a relatively large fluctuation in input voltage can be allowed). Further, in the case where the rising completion time Tr is relatively long (the case where the load is relatively large), the threshold can be made relatively small (i.e., only a relatively small fluctuation in input voltage is allowed).

Thus, the image forming apparatus 100 of the embodiment 2 includes the input voltage detecting portion 950 for detecting the voltage inputted to the image forming apparatus 100. When the preparatory operation is executed, on the basis of a detection result of the input voltage detecting portion 950, the setting portion (engine controller) 403 determines whether or not the contact operation start timing (start timing when the contact operation is started) based on the information on the switching time required for switching the contact and separation state of the developing member 4 from the all separation state to the all contact state acquired by the acquiring portion (developing contact controller) 407. In the embodiment 2, in the case where the difference between the voltage indicated by the detection result of the input voltage detecting portion 950 when a preparatory operation before the present preparatory operation is executed and the voltage indicated by the detection result of the input voltage detecting portion 950 when the present preparatory operation is executed is less than the predetermined value, the setting portion 403 sets the above-described start timing on the basis of the information on the above-described switching time acquired by the acquiring portion 407. In the case where the above-described difference is not less than the above-described predetermined value, the contact operation by the contact and separation unit 500 is started on or after the time when the region on the photosensitive drum 1 exposed to light in the light emission period in the preparatory operation passes through the developing position.

As described above, in the embodiment 2, in the case where the input voltage to the image forming apparatus 100 is detected and is discriminated as being not changed from the assumed input voltage, it is predicated that the developing motor 101 is acquired in a time similar to the time measured in the initializing operation. Then, on the basis of the predicted time, the contact operation start timing of the developing roller 4 is controlled (adjusted). On the other hand, in the case where discrimination that the input voltage is changed from the assumed input voltage is made, there is a possibility that the developing motor 101 is not actuated in an assumed time or that the developing motor 101 is actuated earlier than the assumed time. In that case, the developing motor 101 is actuated, and then contact operation of the developing roller 4 is started after waiting for the passing of the forced light emission region through the developing position. By this, even when the time required for the actuation of the developing motor 101 fluctuates, it is possible to suppress the movement of the toner to the region on the photosensitive drum 1 exposed to light during the actuation of the developing motor 101.

As described above, the present invention was explained in accordance with the specific embodiments, but the present invention is not limited to the above-described embodiments.

In the above-described embodiments, the case where in the light emission period of the preparatory operation before the image formation, the light is forcedly emitted by the exposure unit (laser) in the region including the image forming region with respect to the main scan direction over a predetermined time in order to stably acquire the BD signal was described. However, the present invention is not limited to the embodiments. In the light emission period of the preparatory operation before the image formation, in place of or in addition to the above-described operation, the case where the light is forcedly emitted by the exposure unit (laser) in the region including the image forming region with respect to the main scan direction over a predetermined time in order to control the light quantity (laser light quantity) of the exposure unit also exists. Thus, the present invention is effective as to any light emitting operation which is performed in the light emission period of the preparatory operation before the image formation and in which a potential at which the toner can be moved from the developing member to the image forming region on the photosensitive member is capable of being formed.

Incidentally, there is a constitution in which the non-image portion (portion where the toner should not be deposited) in a substantially entire region on the photosensitive member is exposed to light through minute light emission by the exposure unit to the extent that the toner is not moved from the developing member. In the case where such minute light emission is executed in the preparatory operation before the image formation, the developing member may be contacted to the photosensitive member when the region on the photosensitive member exposed to light by the minute light emission passes through the developing position. The region on the photosensitive member exposed to light in the preparatory operation before the image formation, which is an object on which the toner is not moved in the present invention is a region exposed to light by the exposure unit so that a potential such that the toner is capable of being moved from the developing member and deposited on the region in the case where the developing member is contacted to the region.

Further, in the above-described embodiments, the image forming apparatus is a color image forming apparatus including a plurality of image forming portions, but the present invention is also applicable to a monochromatic image forming apparatus including a single image forming portion for forming a black (single color) image, for example.

According to the present invention, it is possible to shorten the FPOT while suppressing the movement of the toner to the region on the photosensitive drum exposed to light during the rising of the exposure unit.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2021-078187 filed on Apr. 30, 2021, which is hereby incorporated by reference herein in its entirety.

What is claimed is:

1. An image forming apparatus comprising:

a photosensitive drum rotatable in a predetermined rotational direction;

a charging roller configured to electrically charge a surface of said photosensitive drum at a charging position with respect to the rotational direction;

an exposure device configured to expose, to light, the surface of said photosensitive drum charged by said charging roller at an exposure position downstream of the charging position with respect to the rotational direction;

a developing container including a developing roller rotatable and contactable to the surface of said photosensitive drum at a developing position downstream of the exposure position and upstream of the charging position with respect to the rotational direction and configured to supply a developer to said photosensitive drum by said developing roller;

a motor configured to drive said developing roller;

a contact and separation mechanism to which a driving force from said motor is transmitted and configured to switch a state of said developing roller between a contact state in which said developing roller is contacted to said photosensitive drum and a separated state in which said developing roller is separated from said photosensitive drum;

an operation controller configured to control said contact and separation mechanism so as to execute, before image formation:

a light emitting operation for forming a potential at which the developer is capable of being deposited on said photosensitive drum by exposing, to light, a region including an image forming region with respect to a rotational axis direction of said photosensitive drum in a light emission period by said exposure device, and a preparatory operation including actuation of said motor and a contact operation for switching the state of said developing roller from the separated state to the contact state in a switching period by said contact and separation mechanism;

a developing controller configured to acquire information on a switching time which is a time required for switching the state of said developing roller from the separated state to the contact state by executing the contact operation by said contact and separation mechanism; and an engine controller configured to set, on the basis of the information on the switching time acquired by said developing controller, a start timing which is a timing when the contact operation by said contact and separation mechanism is started in the preparatory operation and which is a timing before a region on said photosensitive drum exposed to light in the light emission period reaches the developing position, wherein said engine controller sets the start timing so that said developing roller is in the contact state after the region on said photosensitive drum exposed to light in the light emission period passes through the developing position.

2. An image forming apparatus according to claim 1, wherein said engine controller sets the start timing so that:

in a case that a time indicated by the information on the switching time is a first time, a time from a start of the preparatory operation to the start timing is a second time, and in a case that the time indicated by the information on the switching time is a third time shorter than the first time, the time from the start of the preparatory operation to the start timing is a fourth time longer than the second time.

3. An image forming apparatus according to claim 1, wherein said developing controller includes:

a speed detector configured to acquire information on a rotational speed of said motor; and an amount estimator configured to acquire information on a rotation amount of said motor on the basis of information on a plurality of rotational speeds acquired by said speed detector with a lapse of a time, wherein said developing controller acquires the information on the switching time on the basis of a time required for rotating said motor by a predetermined rotation amount.

4. An image forming apparatus according to claim 3, wherein the predetermined rotation amount is a rotation amount of said motor required for switching the state of said developing roller from the separated state to the contact state by said contact and separation mechanism.

5. An image forming apparatus according to claim 1, wherein said operation controller carries out control so as to execute, before the preparatory operation is executed, a test operation in which the information on the switching time is acquired by said developing controller by performing the contact operation by said contact and separation mechanism, and wherein said engine controller sets the start timing in the preparatory operation executed after the test operation is executed, on the basis of the information on the switching time acquired in the test operation.

6. An image forming apparatus according to claim 5, wherein said operation controller carries out control so as to execute the test operation in a case that a power source of said image forming apparatus is turned on or in a case that an exchange unit of said image forming apparatus is exchanged.

7. An image forming apparatus according to claim 1, wherein said developing controller includes:

a speed detector configured to acquire information on a rotational speed of said motor in a state in which said photosensitive drum is driven by said motor; and an amount estimator configured to acquire information on a rotation amount of said motor on the basis of information on a plurality of rotational speeds acquired by said speed detector with a lapse of a time, wherein said developing controller acquires the information on the switching time on the basis of a time required for rotating said motor by a predetermined first rotation amount, wherein said developing controller acquires information on a passing time which is a time required that the region on said photosensitive drum exposed to light in the light emission period finishes passing through the developing position, on the basis of a time required for rotating said motor by a predetermined second rotation amount, and wherein said engine controller sets the start timing so that said developing roller is in the contact state after the region on said photosensitive drum exposed to light in the light emission period passes through the developing position.

8. An image forming apparatus according to claim 7, wherein the predetermined first rotation amount is a rotation amount of said motor required for switching the state of said developing roller from the separated state to the contact state by said contact and separation mechanism, and the predetermined second rotation amount is a rotation amount of said motor required so that that the region on said photosensitive drum exposed to light in the light emission period is moved from the exposure position to the developing position.

9. An image forming apparatus according to claim 7, wherein said operation controller carries out control so as to execute, before the preparatory operation is executed, a test operation in which the information on the switching time and the information on the passing time are acquired by said developing controller by performing the contact operation by said contact and separation mechanism, and wherein said engine controller sets the start timing in the preparatory operation executed after the test operation is executed, on the basis of the information on the switching time and the information on the passing time which are acquired in the test operation.

10. An image forming apparatus according to claim 9, wherein said operation controller carries out control so as to execute the test operation in a case that a power source of said image forming apparatus is turned on or in a case that an exchange unit of said image forming apparatus is exchanged.

11. An image forming apparatus according to claim 1, further comprising a voltage detector configured to detect a voltage inputted to said image forming apparatus, wherein said engine controller determines, before the preparatory operation is executed, whether or not the start timing is set on the basis of the information on the switching time acquired by said developing controller, on the basis of a detection result of said voltage detector.

12. An image forming apparatus according to claim 11, wherein said preparatory operation includes a first preparatory operation and a second preparatory operation executed before the first preparatory operation, wherein in a case that a difference between a voltage indicated by a detection result of said voltage detector when the second preparatory operation is executed and a voltage indicated by a detection result of said voltage detector when the first preparatory operation is less than a predetermined value, said engine controller sets the start timing on the basis of the information on the switching time acquired by said developing controller, and wherein in a case that the difference is not less than the predetermined value, said operation controller causes said contact and separation mechanism to start the contact operation after the region on said photosensitive drum exposed to light in the light emission period passes through the developing position.

13. An image forming apparatus according to claim 1, wherein said exposure device includes:

a laser diode configured to emit light; and a polygon mirror, wherein said exposure device causes said polygon mirror to rotate and reflects the light emitted by said laser diode, and irradiates said photosensitive drum with the light, and wherein the light emission period is included in a period in which rotation of said polygon mirror is not in a steady state.

* * * * *